US008514665B2

(12) United States Patent
Tokiwa et al.

(10) Patent No.: US 8,514,665 B2
(45) Date of Patent: Aug. 20, 2013

(54) TIME INFORMATION ACQUIRING APPARATUS AND RADIO-CONTROLLED TIMEPIECE

(75) Inventors: Teruhisa Tokiwa, Kunitachi (JP); Takashi Sano, Fussa (JP)

(73) Assignee: Casio Computer Co., Ltd, Tokyo (JP)

( * ) Notice: Subject to any disclaimer, the term of this patent is extended or adjusted under 35 U.S.C. 154(b) by 236 days.

(21) Appl. No.: 13/182,540

(22) Filed: Jul. 14, 2011

(65) Prior Publication Data

US 2012/0026842 A1 Feb. 2, 2012

(30) Foreign Application Priority Data

Jul. 27, 2010 (JP) ..... 2010-167837

(51) Int. Cl.
*G04C 13/00* (2006.01)

(52) U.S. Cl.
USPC ..... 368/47

(58) Field of Classification Search
USPC ..... 368/47; 702/176
See application file for complete search history.

(56) References Cited

U.S. PATENT DOCUMENTS

| | | | | |
|---|---|---|---|---|
| 3,684,964 | A | 8/1972 | Bright et al. | |
| 7,042,808 | B2 | 5/2006 | Saitoh | |
| 8,072,845 | B2 * | 12/2011 | Someya | 368/47 |
| 2005/0195690 | A1 | 9/2005 | Kondo | |
| 2006/0050824 | A1 | 3/2006 | Kondo | |
| 2006/0140282 | A1 | 6/2006 | Kondo | |
| 2008/0240076 | A1 | 10/2008 | Someya | |
| 2009/0248357 | A1 * | 10/2009 | Abe | 702/176 |
| 2009/0296531 | A1 * | 12/2009 | Haartsen et al. | 368/47 |
| 2009/0323478 | A1 | 12/2009 | Someya | |

FOREIGN PATENT DOCUMENTS

| | | | |
|---|---|---|---|
| EP | 1 662 344 | A2 | 5/2006 |
| EP | 1 855 167 | A2 | 11/2007 |
| JP | 11-304973 | | 11/1999 |
| JP | 2002-286882 | | 10/2002 |
| JP | 2006-071318 | | 3/2006 |
| JP | 2006-090770 | | 4/2006 |
| JP | 2008-241351 | | 10/2008 |
| JP | 2010-008324 | | 1/2010 |

OTHER PUBLICATIONS

Translated claims from EP11175357—2413203; Apr. 2, 2013.*
Translated claims from EP11172724—2405315; Apr. 2, 2013.*
Extended European Search Report for European Application No. 11175357.0-1240 dated May 10, 2012.

(Continued)

*Primary Examiner* — Sean Kayes
(74) *Attorney, Agent, or Firm* — Turocy & Watson, LLP

(57) ABSTRACT

A time information acquiring apparatus includes: a first decoder which decodes a time code signal frame by frame so as to generate solo-decoded time information; a first determining section which determines consistency of the solo-decoded time information; a second decoder which combines detection data of the frames, and performs a code determination on the time code signal based on the combined detection data so as to generate sum-up-decoded time information; a second determining section which determines the consistency of the sum-up-decoded time information; and a controller which makes the first decoder generate the solo-decoded time information, the first determining section determine the consistency of the solo-decoded time information, the second decoder generate the sum-up decoded time information, and the second determining section determine the consistency of the sum-up-decoded time information in a predetermined order so as to extract time information having the consistency.

12 Claims, 19 Drawing Sheets

| | 1st FRAME | 2nd FRAME | 3rd FRAME | 4th FRAME | 5th FRAME | 6th FRAME |
|---|---|---|---|---|---|---|
| AREA A | 1 SOLO | 1 SOLO | 1 SOLO | 2 SOLO | 3 SOLO | 4 SOLO |
| AREA B | | 2 SOLO | 2 SOLO | 3 SOLO | 4 SOLO | 5 SOLO |
| AREA C | | | 3 SOLO | 4 SOLO | 5 SOLO | 6 SOLO |
| AREA D | | 1+2 SUM-UP | 1+2 SUM-UP | 1+2 SUM-UP | 1+2 SUM-UP | 1+2 SUM-UP |
| AREA E | | | 2+3 SUM-UP | 3+4 SUM-UP | 3+4 SUM-UP | 3+4 SUM-UP |
| AREA F | | | | | 4+5 SUM-UP | 5+6 SUM-UP |

(56) References Cited

OTHER PUBLICATIONS

Extended European Search Report for European Application No. 11172724.4-1240/2405315 mailed on Feb. 13, 2012.

Office Action dated Mar. 13, 2013 for U.S. Appl. No. 13/174,907, 27 pages.

Japanese Office Action for Japanese Application No. 2010-167837 mailed on May 8, 2012.

* cited by examiner

FIG. 4

| | NEWLY GENERATED TIME DATA | |
|---|---|---|
| | SOLO DECODING | SUM-UP DECODING |
| 1st FRAME | 1 | |
| 2nd FRAME | 2 | 1+2 |
| 3rd FRAME | 3 | 2+3 |
| 4th FRAME | 4 | 3+4 |
| 5th FRAME | 5 | 4+5 |
| 6th FRAME | 6 | 5+6 |

FIG. 5

| | 1st FRAME | 2nd FRAME | 3rd FRAME | 4th FRAME | 5th FRAME | 6th FRAME |
|---|---|---|---|---|---|---|
| AREA A | 1 SOLO | 1 SOLO | 1 SOLO | 2 SOLO | 3 SOLO | 4 SOLO |
| AREA B | | 2 SOLO | 2 SOLO | 3 SOLO | 4 SOLO | 5 SOLO |
| AREA C | | | 3 SOLO | 4 SOLO | 5 SOLO | 6 SOLO |
| AREA D | | 1+2 SUM-UP | 1+2 SUM-UP | 1+2 SUM-UP | 1+2 SUM-UP | 1+2 SUM-UP |
| AREA E | | | 2+3 SUM-UP | 3+4 SUM-UP | 3+4 SUM-UP | 3+4 SUM-UP |
| AREA F | | | | | 4+5 SUM-UP | 5+6 SUM-UP |

FIG. 6

22b

| | COMPARISON BETWEEN TIME DATA AND TIME CALCULATION DATA FOR CONSISTENCY CHECK | | COMPARISON BETWEEN TIME DATA AND TIME DATA FOR CONSISTENCY CHECK | |
|---|---|---|---|---|
| | SOLO DECODING (k=1) | SUM-UP DECODING (k=2) | SOLO DECODING (k=3) | SUM-UP DECODING (k=4) |
| 1st FRAME (j=1) | 1 | | | |
| 2nd FRAME (j=2) | 2 | 1+2 | | |
| 3rd FRAME (j=3) | 3 | 2+3 | 1, 2, 3 | |
| 4th FRAME (j=4) | 4 | 3+4 | 2, 3, 4 | |
| 5th FRAME (j=5) | 5 | 4+5 | 3, 4, 5 | |
| 6th FRAME (j=6) | 6 | 5+6 | 4, 5, 6 | 1+2, 3+4, 5+6 |

FIG. 7

| | 1st FRAME | 2nd FRAME | 3rd FRAME | 4th FRAME | 5th FRAME | 6th FRAME |
|---|---|---|---|---|---|---|
| AREA A | 1 SOLO | 1 SOLO | 1 SOLO | 3 SOLO | 4 SOLO | 4 SOLO |
| AREA B | | 2 SOLO | 2 SOLO | 4 SOLO | 5 SOLO | 5 SOLO |
| AREA C | | | 3 SOLO | 3 SOLO | 3+4 SUM-UP | 6 SOLO |
| AREA D | | 1+2 SUM-UP | 1+2 SUM-UP | 1+2 SUM-UP | 1+2 SUM-UP | 1+2 SUM-UP |
| AREA E | | | 2+3 SUM-UP | 3+4 SUM-UP | 2+3 SUM-UP | 3+4 SUM-UP |
| AREA F | | | | 2+3 SUM-UP | 4+5 SUM-UP | 5+6 SUM-UP |

FIG. 8

22b1

| | COMPARISON BETWEEN TIME DATA AND TIME CALCULATION DATA FOR CONSISTENCY CHECK | | COMPARISON BETWEEN TIME DATA AND TIME DATA FOR CONSISTENCY CHECK | |
|---|---|---|---|---|
| | SOLO DECODING (k=1) | SUM-UP DECODING (k=2) | SOLO DECODING (k=3) | SUM-UP DECODING (k=4) |
| 1st FRAME (j=1) | | | | |
| 2nd FRAME (j=2) | 1, 2 | | | |
| 3rd FRAME (j=3) | 2, 3 | | 1, 2, 3 | |
| 4th FRAME (j=4) | 3, 4 | 1+2, 3+4 | | |
| 5th FRAME (j=5) | 4, 5 | 2+3, 4+5 | | |
| 6th FRAME (j=6) | 5, 6 | 3+4, 5+6 | 4, 5, 6 | 1+2, 3+4, 5+6 |

| | UNITS DIGIT OF MINUTES OF $j^{th}$ FRAME (RECEIVED AT X:08) | | | |
|---|---|---|---|---|
| | 8-MINUTE BIT | 4-MINUTE BIT | 2-MINUTE BIT | 1-MINUTE BIT |
| "1" PROXIMITY | 10 | 0 | 0 | 0 |
| "0" PROXIMITY | 0 | 10 | 10 | 10 |

FIG. 14

| BCD VALUE DETERMINATION PATTERN FOR UNITS DIGIT OF MINUTES | | TOTAL VALUE OF PROXIMITY |
|---|---|---|
| 0 | (0000) | 30 |
| 1 | (0001) | 20 |
| 2 | (0010) | 20 |
| 3 | (0011) | 10 |
| 4 | (0100) | 20 |
| 5 | (0101) | 10 |
| 6 | (0110) | 10 |
| 7 | (0111) | 0 |
| 8 | (1000) | 40 |
| 9 | (1001) | 30 |

FIG. 15

| | UNITS DIGIT OF MINUTES OF $j^{th}$ FRAME (RECEIVED AT X:08) | | | |
|---|---|---|---|---|
| | 8-MINUTE BIT | 4-MINUTE BIT | 2-MINUTE BIT | 1-MINUTE BIT |
| "1" PROXIMITY | 8 | 6 | 2 | 8 |
| "0" PROXIMITY | 2 | 4 | 8 | 2 |

FIG. 16

| BCD VALUE DETERMINATION PATTERN FOR UNITS DIGIT OF MINUTES | | TOTAL VALUE OF PROXIMITY |
|---|---|---|
| 0 | (0000) | 16 |
| 1 | (0001) | 22 |
| 2 | (0010) | 10 |
| 3 | (0011) | 16 |
| 4 | (0100) | 18 |
| 5 | (0101) | 24 |
| 6 | (0110) | 12 |
| 7 | (0111) | 18 |
| 8 | (1000) | 22 |
| 9 | (1001) | 28 |

FIG. 19A

| | UNITS DIGIT OF MINUTES OF $(j-1)^{th}$ FRAME (RECEIVED AT X:08) | | | |
|---|---|---|---|---|
| | 8-MINUTE BIT | 4-MINUTE BIT | 2-MINUTE BIT | 1-MINUTE BIT |
| "1" PROXIMITY | 10 | 0 | 0 | 0 |
| "0" PROXIMITY | 0 | 10 | 10 | 10 |

FIG. 19B

| | UNITS DIGIT OF MINUTES OF $j^{th}$ FRAME (RECEIVED AT X:09) | | | |
|---|---|---|---|---|
| | 8-MINUTE BIT | 4-MINUTE BIT | 2-MINUTE BIT | 1-MINUTE BIT |
| "1" PROXIMITY | 10 | 0 | 0 | 10 |
| "0" PROXIMITY | 0 | 10 | 10 | 0 |

FIG. 20

| BCD VALUE DETERMINATION PATTERN FOR UNITS DIGIT OF MINUTES | | | | TOTAL VALUE OF PROXIMITY | | |
|---|---|---|---|---|---|---|
| $(j-1)^{th}$ FRAME (ONE MINUTE BEFORE) | | $j^{th}$ FRAME (THIS TIME) | | ONE MINUTE BEFORE | THIS TIME | TOTAL |
| 0 | (0000) | 1 | (0001) | 30 | 30 | 60 |
| 1 | (0001) | 2 | (0010) | 20 | 10 | 30 |
| 2 | (0010) | 3 | (0011) | 20 | 20 | 40 |
| 3 | (0011) | 4 | (0100) | 10 | 10 | 20 |
| 4 | (0100) | 5 | (0101) | 20 | 20 | 40 |
| 5 | (0101) | 6 | (0110) | 10 | 0 | 10 |
| 6 | (0110) | 7 | (0111) | 10 | 10 | 20 |
| 7 | (0111) | 8 | (1000) | 0 | 30 | 30 |
| 8 | (1000) | 9 | (1001) | 40 | 40 | 80 |
| 9 | (1001) | 0 | (0000) | 30 | 20 | 50 |

FIG. 21A

| | UNITS DIGIT OF MINUTES OF $(j-1)^{th}$ FRAME (RECEIVED AT X:08) | | | |
|---|---|---|---|---|
| | 8-MINUTE BIT | 4-MINUTE BIT | 2-MINUTE BIT | 1-MINUTE BIT |
| "1" PROXIMITY | 8 | 6 | 2 | 8 |
| "0" PROXIMITY | 2 | 4 | 8 | 2 |

FIG. 21B

| | UNITS DIGIT OF MINUTES OF $j^{th}$ FRAME (RECEIVED AT X:09) | | | |
|---|---|---|---|---|
| | 8-MINUTE BIT | 4-MINUTE BIT | 2-MINUTE BIT | 1-MINUTE BIT |
| "1" PROXIMITY | 7 | 1 | 2 | 7 |
| "0" PROXIMITY | 3 | 9 | 8 | 3 |

FIG. 22

| BCD VALUE DETERMINATION PATTERN FOR UNITS DIGIT OF MINUTES | | | | TOTAL VALUE OF PROXIMITY | | |
|---|---|---|---|---|---|---|
| $(j-1)^{th}$ FRAME (ONE MINUTE BEFORE) | | $j^{th}$ FRAME (THIS TIME) | | ONE MINUTE BEFORE | THIS TIME | TOTAL |
| 0 | (0000) | 1 | (0001) | 16 | 27 | 43 |
| 1 | (0001) | 2 | (0010) | 22 | 17 | 39 |
| 2 | (0010) | 3 | (0011) | 10 | 21 | 31 |
| 3 | (0011) | 4 | (0100) | 16 | 15 | 31 |
| 4 | (0100) | 5 | (0101) | 18 | 19 | 37 |
| 5 | (0101) | 6 | (0110) | 24 | 9 | 33 |
| 6 | (0110) | 7 | (0111) | 12 | 13 | 25 |
| 7 | (0111) | 8 | (1000) | 18 | 27 | 45 |
| 8 | (1000) | 9 | (1001) | 22 | 31 | 53 |
| 9 | (1001) | 0 | (0000) | 28 | 23 | 51 |

TIME INFORMATION ACQUIRING APPARATUS AND RADIO-CONTROLLED TIMEPIECE

BACKGROUND OF THE INVENTION

1. Field of the Invention

The present invention relates to a time information acquiring apparatus which acquires time information with consistency from a time code signal included in a standard radio wave (standard time and frequency signal), and to a radio-controlled timepiece including the time information acquiring apparatus.

2. Description of the Related Art

Conventionally, there is known, for example, according to Japanese Patent Application Laid-open Publication No. 2002-286882, an apparatus which decodes a time code signal included in the standard radio wave so as to generate time information, the apparatus in which a plurality of pieces of time information is generated from a plurality of frames of the time code signal, and a consistency check is performed on the generated time information.

Currently, in order to acquire more accurate time information even under a poor reception environment, inventors including the inventor of the present invention develop technologies for decoding, the technologies by which a time code signal is not decoded frame by frame, but decoded by combining detection data of a plurality of frames thereof in order to perform a code determination.

However, for example, when a decoding process is performed by receiving three frames (the first to the third frames) of a time code signal under reception environments where the noise levels of the three frames thereof are the same and where the noise level of one frame thereof is higher than the noise levels of the other two frames thereof, the accuracy of the generated time information varies depending on a decoding method.

In the following, the first time information acquired by decoding a time code signal by using only the first frame thereof, the second time information acquired by decoding the time code signal by using only the second frame thereof, the third time information acquired by decoding the time code signal by using only the third frame thereof, the fourth time information acquired by decoding the time code signal by combining the first frame thereof with the second frame thereof, and the fifth time information acquired by decoding the time code signal by combining the second frame thereof and the third frame thereof are compared with one another.

When the noise levels of the three frames of the time code signal are the same, the accuracy of the five time information is as follows:

the first time information≈the second time information≈the third time information;

each of the first to the third time information<each of the fourth and the fifth time information; and the fourth time information≈the fifth time information.

On the other hand, when much noise temporarily enters into the time code signal, and hence the noise level of the second frame thereof is higher than the noise levels of the other frames, the accuracy of the five time information is as follows;

each of the second, the fourth, and the fifth time information<each of the first and the third time information.

That is, although the fourth and the fifth time information are acquired by decoding the time code signal by combining the detection data of two frames of the time code signal, because the second frame which includes much noise is used as a material of the fourth and the fifth time information, the accuracy of the fourth and the fifth time information is lower than the accuracy of the first and the third time information each of which is acquired by decoding the time code signal by using only one frame thereof including less noise.

In other words, the accuracy of the time information acquired by a decoding method and the accuracy of the time information acquired by another decoding method may be reversed depending on a situation. Therefore, it is considered that, by using a plurality of types of decoding methods with a plurality of types of methods of a consistency check, more accurate time information can be acquired, even in a case where each of the time information is generated from a same number of frames of a time code signal.

The present invention provides a time information acquiring apparatus and a radio-controlled timepiece which can acquire more accurate time information having consistency by using a plurality of types of decoding processes with a plurality of types of consistency checking processes.

SUMMARY OF THE INVENTION

An aspect of the present invention is a time information acquiring apparatus including: a first decoder which decodes a time code signal frame by frame so as to generate solo-decoded time information, the time code signal which is extracted and inputted from a standard radio wave; a first determining section which determines consistency of the solo-decoded time information generated by the first decoder; a second decoder which combines detection data of a plurality of the frames of the time code signal, and performs a code determination on the time code signal based on the combined detection data of the frames so as to generate sum-up-decoded time information; a second determining section which determines the consistency of the sum-up-decoded time information generated by the second decoder; and a controller which makes (i) the first decoder generate the solo-decoded time information, (ii) the first determining section determine the consistency of the solo-decoded time information, (iii) the second decoder generate the sum-up decoded time information, and (iv) the second determining section determine the consistency of the sum-up-decoded time information in a predetermined order so as to extract time information having the consistency.

BRIEF DESCRIPTION OF THE DRAWINGS

FIG. 4 is a table for explaining time data which are newly generated each time one frame of a time code signal is inputted;

FIG. 5 is a table for explaining steps to store the time data into a time data storage region;

FIG. 6 shows contents of a consistency check pattern table;

FIG. 7 is a table for explaining steps to store the time data into the time data storage region according to a modification;

FIG. 8 is a table showing contents of a consistency check pattern table according to the modification;

FIG. 14 is a table showing determination patterns for a 4-bit code string indicating the units digit of minutes, and total values of the proximity based on values of the proximity shown in FIG. 13;

FIG. 15 is a table showing the proximity to a pulse signal of the 0 code and the proximity to a pulse signal of the 1 code with respect to 4 bits indicating the units digit of minutes in a time code signal having noise;

FIG. 16 is a table showing determination patterns for a 4-bit code string indicating the units digit of minutes, and total values of the proximity based on values of the proximity shown in FIG. 15;

FIGS. 19A and 19B are tables each of which shows the proximity to a pulse signal of the 0 code and the proximity to a pulse signal of the 1 code with respect to 4 bits indicating the units digit of minutes in an ideal time code signal having no noise, wherein FIG. 19A is for the $(j-1)^{th}$ frame transmitted and received at x:08, while FIG. 19B is for the $j^{th}$ frame transmitted and received at x:09;

FIG. 20 is a table showing determination patterns for a 4-bit code string indicating the units digit of minutes over two frames, and total values of the proximity based on values of the proximity shown in FIGS. 19A and 19B;

FIGS. 21A and 21B are tables showing the proximity to a pulse signal of the 0 code and the proximity to a pulse signal of the 1 code with respect to 4 bits indicating the units digit of minutes in a time code signal having noise, wherein FIG. 21A is for the $(j-1)^{th}$ frame transmitted and received at x:08, while FIG. 21B is for the $j^{th}$ frame transmitted and received at x:09;

FIG. 22 is a table showing determination patterns for a 4-bit code string indicating the units digit of minutes over two frames, and total values of the proximity based on values of the proximity shown in FIGS. 21A and 21B;

DESCRIPTION OF THE PREFERRED EMBODIMENT

In the following, an embodiment of the present invention is described with reference to the accompanying drawings.

Figure 1:
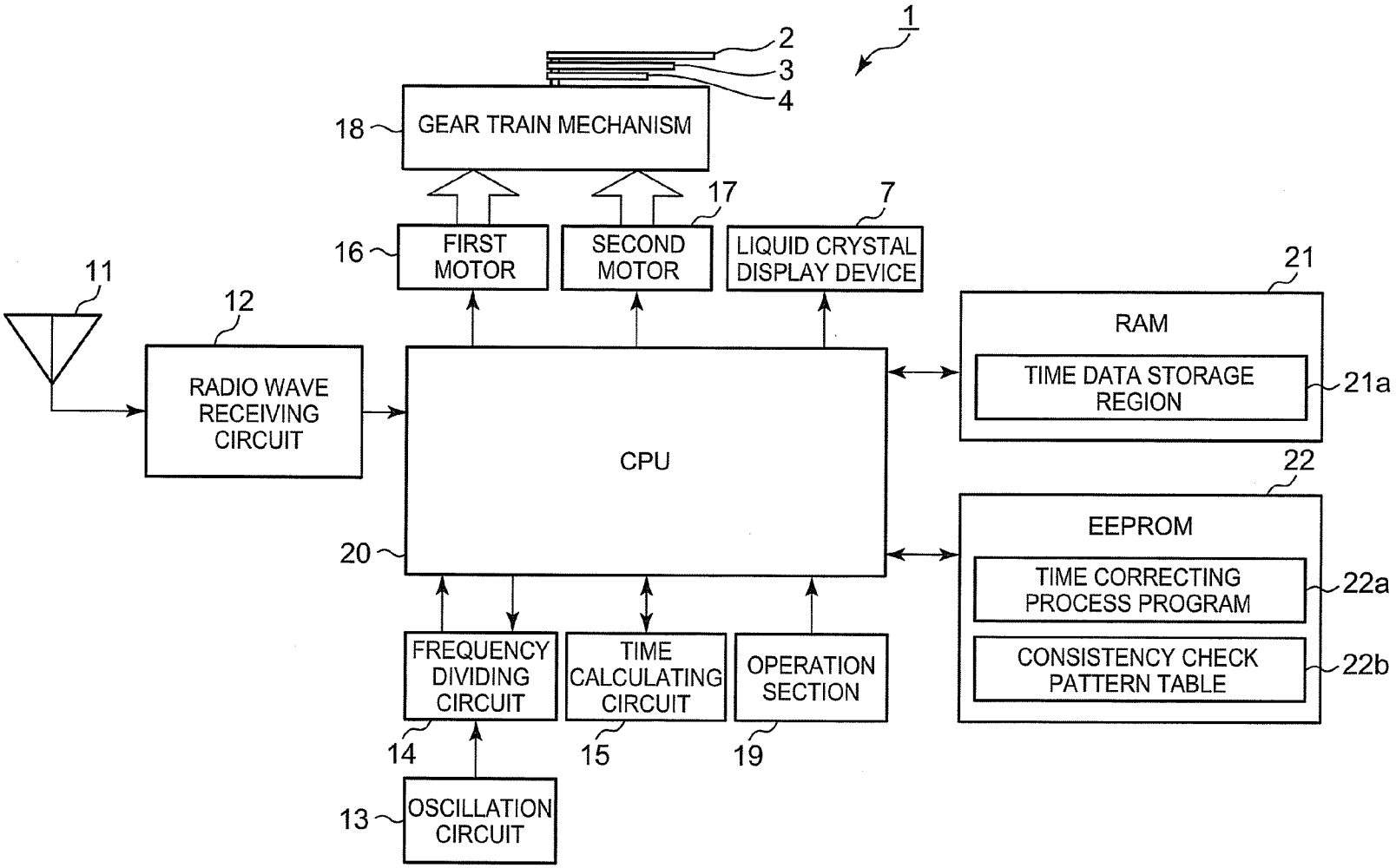
FIG. 1 is a block diagram showing the overall configuration of a radio-controlled timepiece according to an embodiment of the present invention.

FIG. 1 is a block diagram showing the overall configuration of a radio-controlled timepiece 1 according to an embodiment of the present invention.

The radio-controlled timepiece 1 according to the embodiment is an electronic timepiece having a function of receiving a standard radio wave including a time code so as to automatically correct the time. The radio-controlled timepiece 1 displays the time by hands (a second hand 2, a minute hand 3, and an hour hand 4) which revolve on a dial plate, and by a liquid crystal display device 7 which is disposed on the dial plate, and displays various information.

As shown in FIG. 1, the radio-controlled timepiece 1 includes an antenna 11 which receives the standard radio wave, a radio wave receiving circuit (radio wave receiving section) 12 which demodulates the standard radio wave so as to generate a time code signal, an oscillation circuit 13 and a frequency dividing circuit 14 as a timer circuit which generates various timing signals, a time calculating circuit (time calculating section) 15 which calculates the current time, a first motor 16 which drives the second hand 2 to revolve, a second motor 17 which drives the minute hand 3 and the hour hand 4 to revolve, a gear train mechanism 18 which transmits the rotational driving force of the first motor 16 and the second motor 17 to their respective hands, an operation section 19 having a plurality of operation buttons, the operation section 19 through which an operation command is inputted from outside, a CPU (Central Processing Unit) 20 as a controller which controls the radio-controlled timepiece 1 as a whole, a RAM (Random Access Memory) 21 which provides a memory space for the CPU 20 to work, and a ROM (Read-Only Memory) 22 which stores pieces of control data and control programs. A time information acquiring apparatus according to the embodiment of the present invention is composed of the CPU 20, the RAM 21, and the ROM 22.

The first motor 16 and the second motor 17 are stepping motors. The first motor 16 drives the second hand 2 to revolve stepwise, and the second motor 17 drives the minute hand 3 and the hour hand 4 to revolve stepwise, independently from each other. On a normal condition to display the time, the first motor 16 is driven one step every one second so as to drive the second hand 2 to make one revolution in one minute. The second motor 17 is driven one step every 10 seconds so as to drive the minute hand 3 to make one revolution in 60 minutes, and to drive the hour hand 4 to make one revolution in 12 hours.

The radio wave receiving circuit 12 includes an amplifier which amplifies a signal received by the antenna 11, a filter which extracts only a frequency content corresponding to the standard radio wave from the received signal, a demodulator which demodulates the received signal so as to extract a time code signal, the received signal of which the amplitude is modulated, and a comparator which performs waveform shaping on the time code signal so as to make the time code signal a signal of a high level and a low level, and outputs the signal outsides. Although not particularly limited, the radio wave receiving circuit 12 is configured as a low active output by which the output is a low level when the amplitude of the standard radio wave is large, and the output is a high level when the amplitude of the standard radio wave is small.

The frequency dividing circuit 14 is capable of changing a value of the frequency-dividing ratio to another value thereof when receiving a command from the CPU 20. Furthermore, the frequency dividing circuit 14 is capable of outputting various timing signals to the CPU 20 in parallel. For example, the frequency dividing circuit 14 generates a one-second cycle timing signal and supplies the signal to the CPU 20 in order to update time calculation data of the time calculating circuit 15 on a one-second cycle, while generating a sampling-frequency timing signal and supplying the signal to the CPU 20 when taking in a time code signal outputted from the radio wave receiving circuit 12.

The RAM 21 includes a time data storage region 21*a* as a storing section which stores time data generated in a time correcting process each time one frame of the time code signal is inputted. In the embodiment, at the maximum, six frames of the time code signal are taken in and 11 time data are generated based thereon. However, by an optimized storing process, the capacity of the time data storage region 21*a* is reduced to a capacity which can store six time data thereof at the maximum.

In the ROM 22, as the control programs, a time displaying process program by which the current time is calculated while the current time is displayed by driving the hands (the second hand 2, the minute hand 3, and the hour hand 4) and the liquid crystal display device 7, a time correcting process program 22*a* by which the time is automatically corrected by receiving the standard radio wave, and the like are stored. In addition, as the control data, a consistency check pattern table 22*b* and the like are stored in the ROM 22. The consistency check pattern table 22*b* shows that, by which decoding method and based on which frame/frames of the time code signal, each of the time data is generated, and by which method, a consistency checking process is performed on each of the generated time data.

[Time Correcting Process]

Next, the time correcting process performed in the radio-controlled timepiece 1 is described.

Figure 2:
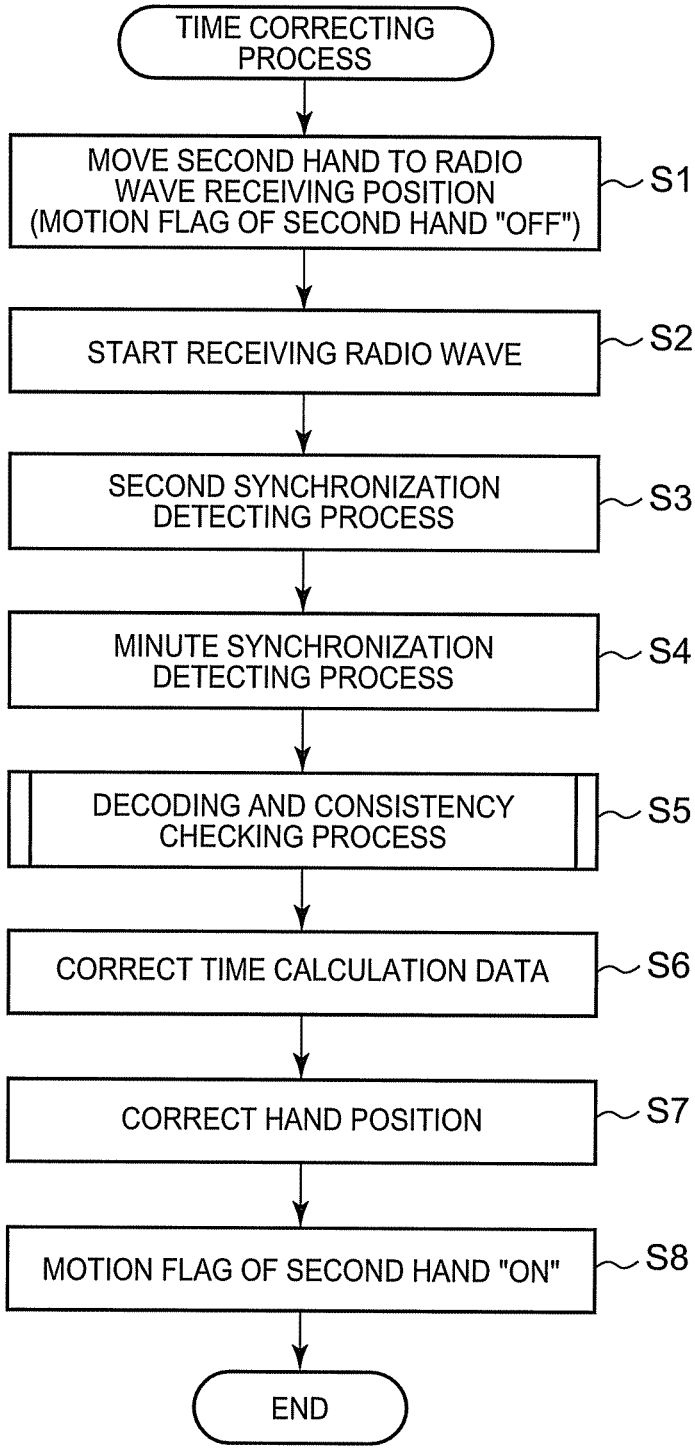
FIG. 2 is a flowchart showing control steps of a time correcting process performed by a CPU.

FIG. 2 is a flowchart of the time correcting process performed by the CPU 20.

The time correcting process starts at a preset time, or at a time when a predetermined operation command is inputted through the operation section 19.

During the time correcting process, while the second hand 2 is controlled in such a way that a motion of the second hand 2 every one second stops, the minute hand 3 and the hour hand 4 are controlled in such a way that motions of the minute hand 3 and the hour hand 4 every 10 seconds continue. Consequently, when the time correcting process starts, the CPU 20 fast-forwards the second hand 2 to a position on the dial plate, the position where it is indicated that the radio wave is being received, and then sets a motion flag of the second hand 2 in the RAM 21 to OFF (Step S1). Accordingly, the motion of the second hand 2 every one second stops. On the other hand, the motions of the minute hand 3 and the hour hand 4 every 10 seconds continue as the time displaying process is performed in parallel with the time correcting process.

Next, the CPU 20 starts a receiving process by operating the radio wave receiving circuit 12 (Step S2). Consequently, the standard radio wave is received, and a time code signal indicated by a high level and a low level is supplied from the radio wave receiving circuit 12 to the CPU 20.

When the time code signal is supplied, the CPU 20 performs a second synchronization detecting process by which a second synchronization point (a synchronization point for each of 0.0 sec. to 59.0 sec.) is detected from the time code signal (Step S3), and a minute synchronization detecting process by which a minute synchronization point (a synchronization point for x min. 00 sec., the "x" is an arbitrary value) is detected therefrom (Step S4).

The second synchronization detecting process at Step S3 is performed, for example, by sampling the time code signal for a plurality of seconds, detecting a timing at which a change of the waveform (a change from a high level to a low level in a case of the Japan standard radio wave of JJY) appears, the change which appears on a one-second cycle, and then determining the timing as the second synchronization point.

The minute synchronization detecting process at Step S4 is performed, for example, by detecting a marker pulse signal (the second pulse signal of two consecutive pulse signals each of which has a pulse width of 200 ms) which is disposed at the starting point of a frame of the time code signal, and determining the start-end of the marker pulse signal as the minute synchronization point.

When the second synchronization point and the minute synchronization point are detected, the CPU 20 performs a decoding and consistency checking process by which codes of pulse signals included in the time code signal are determined based on the second synchronization point and the minute synchronization point so that time data is generated, and also a consistency check is performed on the generated time data (Step S5: a controller). This decoding and consistency checking process is described below in detail.

When time data is acquired by the decoding process, the CPU 20 corrects the time calculation data of the time calculating circuit 15 based on the time data (Step S6: a time correcting section). In addition, if necessary, the CPU 20 fast-forwards the minute hand 3 and the hour hand 4 so as to correct the positions thereof (Step S7). Then, the CPU 20 turns the motion flag of the second hand 2 to ON in order to drive the stopped second hand 2 to revolve in synchronism with the time calculation data (Step S8), and ends the time correcting process.

[Decoding and Consistency Checking Process]

Next, the decoding and consistency checking process performed at Step S5 is described in detail.

Figure 3:
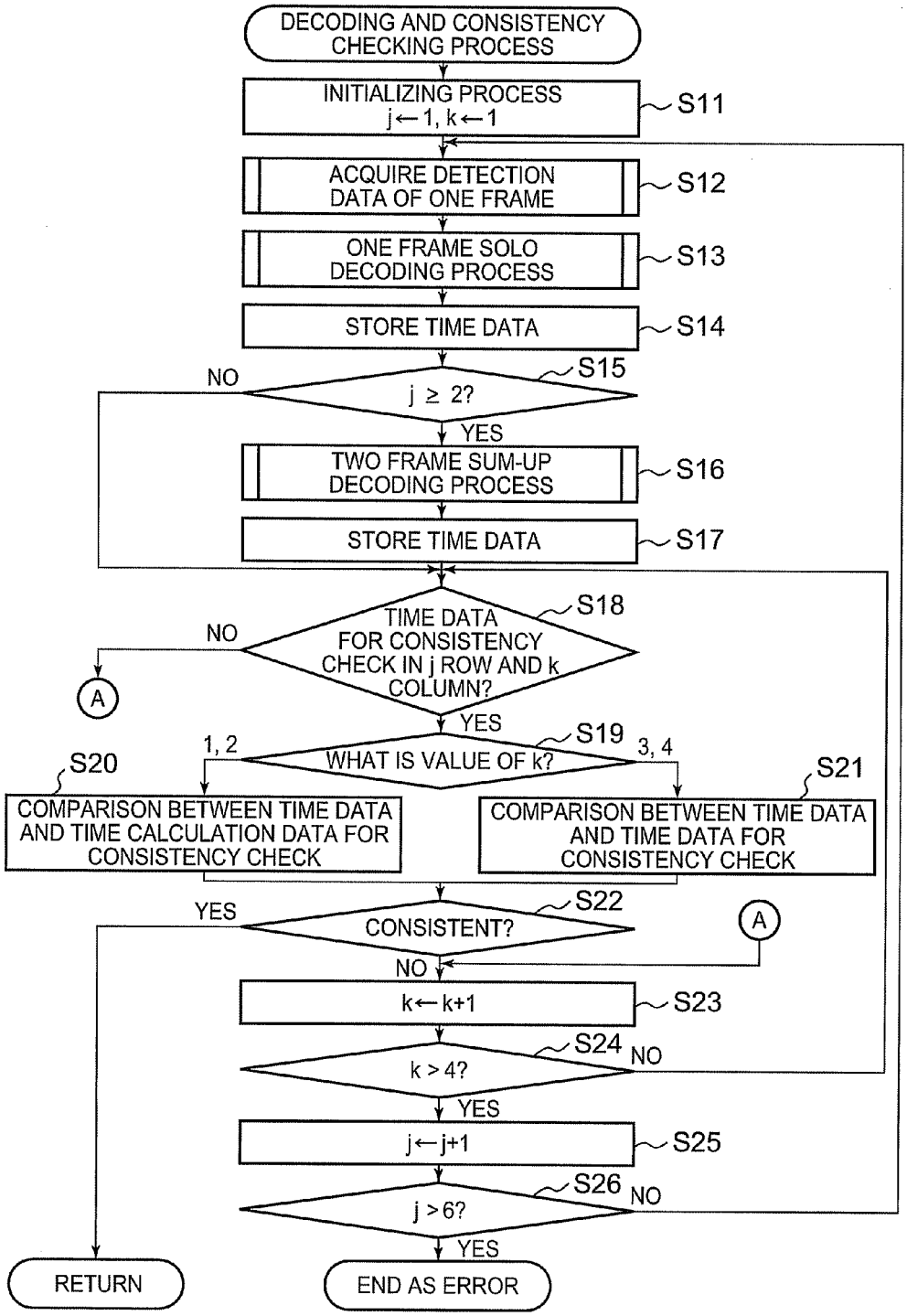
FIG. 3 is a flowchart showing control steps of a decoding and consistency checking process performed at Step S5 in FIG. 2.

FIG. 3 is a flowchart of the decoding and consistency checking process.

First, the outline of the decoding and consistency checking process is described. In the decoding and consistency checking process, each time one frame of a time code signal is taken in, two types of decoding processes are taken when executable in order to generate time data. One of the two decoding processes is decoding the time code signal by using only one frame of the time code signal, and the other one of the two decoding processes is decoding the time code signal by summing up the detection data of the frame taken in the last time and the detection data of the frame taken in this time. Then, the consistency check is performed on the generated time data by a plurality of types of methods. When the result of the consistency check is "consistent", the time data is/are determined as a decoding result. On the other hand, when the result of the consistency check is "inconsistent", the decoding and consistency checking process is repeatedly performed by taking in six frames of the time code signal at the maximum.

Next, the details of the decoding and consistency checking process are described. In FIG. 3, a variable j indicates a frame number of a frame of a time code signal among six frames thereof which are taken in at the maximum in order. In addition, a variable k indicates a type number of a consistency checking process/method among four types thereof.

When starting the decoding and consistency checking process, the CPU 20 performs an initializing process such as setting various variables used for the decoding and consistency checking process to default values thereof (Step S11). Here, "1" is set to both the variable j and the variable k.

Next, the CPU 20 samples pulse signals of one frame of the time code signal during a predetermined period of time so as to acquire detection data of the frame (Step S12). Then, the CPU 20 performs a decoding process (solo decoding) which uses the detection data of the one frame only so as to perform a code determination of the time code signal based thereon, thereby generating time data (Step S13: a first decoder). The generated time data is stored into the time data storage region 21*a* under a predetermined condition (Step S14). The decoding process (solo decoding) at Step S13 is described below in detail.

Next, the CPU 20 checks whether or not the frame acquired this time is the second frame or a frame thereafter (j≧2) (Step S15). When the frame is the second frame or a frame thereafter, the CPU 20 performs a decoding process (sum-up decoding) which uses the detection data of one frame thereof acquired the last time and the detection data of another one frame thereof acquired this time, the two detection data being summed up, so as to perform the code determination of the time code signal based thereon, thereby generating time data (Step S16: a second decoder). The generated time data is stored into the time data storage region 21*a* under the predetermined condition (Step S17). The decoding process (sum-up decoding) at Step S16 is described below in detail.

FIG. 4 is a table for explaining time data newly generated in Steps S12 to S17 each time one frame of the time code signal is inputted.

Steps S12 to S17 are repeated by a judgment made in a judging process at Step S26 described below until six frames, i.e. the first to the sixth frames, of the time code signal are inputted at the maximum. Consequently, as shown in FIG. 4, time data is/are newly generated each time one frame thereof is inputted.

More specifically, when the detection data of the first frame is acquired, as shown in the "$1^{st}$ frame" row and "solo decoding" column in FIG. 4, time data is generated by the solo decoding based on the detection data of the first frame. In the table shown in FIG. 4, the time data is indicated by "1" which is the frame number of the frame which is a material of the time data.

When the detection data of the second frame is acquired, as shown in the "$2^{nd}$ frame" row in FIG. 4, the time data "2" and the time data "1+2" are respectively generated by the solo decoding and the sum-up decoding based on the detection data of the second frame. Each of the time data is indicated by the frame number of the frame/frames which is a material/materials of the time data, respectively.

Similarly, when the detection data of the third to the sixth frames are acquired, as shown in the "$3^{rd}$ frame" to "$6^{th}$ frame" rows in FIG. 4, time data are generated by the solo decoding and the sum-up decoding. At the maximum, 11 time data are generated.

FIG. 5 is a table for explaining steps to store the time data into the time data storage region 21*a*. In FIG. 5, in the "$1^{st}$ frame" to "$6^{th}$ frame" columns, contents of storage areas A to F of the time data storage section 21*a* are shown. That is, FIG. 5 shows that, into which storage area among the storage areas A to F, each of the time data is stored, the time data which is generated when one of the first to sixth frames is inputted. In addition, in FIG. 5, the newly added time data which is/are generated and stored when a frame indicated in a column of the table is inputted is/are shown by hatching. Each of the time data is indicated by the frame number of the frame/frames which is a material/materials of the time data, and also indicated by the types of the decoding processes. For example, "1 solo" indicates the time data generated based on the first frame of the time code signal by the solo decoding, while "1+2 sum-up" indicates the time data generated based on the first and the second frames by the sum-up decoding.

In a time data storing process at Steps S14 and S17, as shown in FIG. 5, each of the generated time data is stored into one of the six storage areas A to F of the time data storage region 21*a* under a predetermined condition. The condition for deciding into which one of the storage areas A to F each of the time data is stored is either a condition that the time data is stored into an empty storage area thereof or a condition that the time data is stored into a storage area thereof by replacing time data stored in the storage area, the time data which is not used for the consistency check later.

In the storing process, a storage area which meets the condition may be retrieved at the time of storing time data, or storage destinations or steps of replacing time data may be incorporated into a program in advance.

FIG. 6 shows contents of the consistency check pattern table 22*b* according to the embodiment of the present invention. In FIG. 6, time data to be subjected to the consistency check which is performed at the time of processing each of the first to the sixth frames is/are shown by the "$1^{st}$ frame (j=1)" to "$6^{th}$ frame (j=6)" rows, and the types of methods of the consistency check (k=1 to 4) are shown by the four columns. In addition, in the table of FIG. 6, each of the time data is indicated by the frame number of the frame/frames which is a material/materials of the time data.

In the embodiment, as the methods of the consistency check of the time data, the first to the fourth methods are adopted. The first method (k=1) is a method by which one time data generated by the solo decoding is compared with the time calculation data of the time calculating circuit 15 (the time calculated by the time calculating circuit 15), and when a difference therebetween is within a predetermined range (±30 sec.), the time data is determined as "consistent", and when not, the time data is determined as "inconsistent". The second method (k=2) is a method by which one time data generated by the sum-up decoding is compared with the time calculation data of the time calculating circuit 15, and when a difference therebetween is within the predetermined range, the time data is determined as "consistent", and when not, the time data is determined as "inconsistent".

The third method (k=3) is a method by which three time data generated by the solo decoding are compared with one another, and when a difference between each two consecutive time data is one minute, the time data are determined as "consistent", and when not, the time data are determined as "inconsistent". The fourth method (k=4) is a method by which three time data generated by the sum-up decoding at two-frame intervals are compared with one another, and when a difference between each two consecutive time data is two minutes, the time data are determined as "consistent", and when not, the time data are determined as "inconsistent". The consistency check by the first and the third methods makes up a first determining section, and the consistency check by the second and the fourth methods makes up a second determining section. Furthermore, the consistency checks by the first, the second, the third, and the fourth methods make up a first, a second, a third, and a fourth comparing and determining sections, respectively.

In the consistency checking process at Step S18 and steps thereafter in the decoding and consistency checking process shown in FIG. 3, the consistency check pattern table 22*b* is used. When generating time data in Steps S12 to S17, and then proceeding to its next step, the CPU 20 checks the consistency check pattern table 22*b* in the ROM 22 so as to determine whether or not time data to be subjected to the consistency check is registered in the j row and k column (Step S18). A value of the variable j indicates the frame number of a frame of the time code signal, the frame which is inputted just before, and a value of the variable k indicates the type number of a method among four types of methods of the consistency check.

When the time data to be subjected to the consistency check is registered therein, the CPU 20 checks a value of the variable k (Step S19), and the consistency check is performed in accordance with the value of the variable k (Step S20 or S21). The methods of the consistency check are described above, the methods which respectively correspond to values of the variable k.

CPU 20 checks whether the result of the consistency check is "consistent" or "inconsistent" (Step S22). When the result thereof is "consistent", the CPU 20 determines that the time data is accurate time data, and ends the decoding and consistency checking process.

On the other hand, when the result thereof is "inconsistent", the CPU 20 updates the value of the variable k which indicates the method type of a method among four types of the methods of the consistency check (Step S23), and checks whether or not the value of the variable k exceeds the maximum value thereof (k>4) (Step S24). When the value of the variable k does not exceed the maximum value thereof, the CPU 20 returns to Step S18. That is, when time data having the "consistent" result is not acquired by a loop process of Steps S18 to S24, the consistency check is performed on the time data registered in the four columns of a same row in the consistency check pattern table 22*b* (FIG. 6) in order.

On the other hand, when it is judged that the value of the variable k exceeds the maximum value thereof in a judging process at Step S24, the CPU 20 updates a value of the variable j which indicates the frame number of an inputted frame of the time code signal (Step S25), and checks whether or not the value of the variable j exceeds the maximum value thereof (j>6) (Step S26). When the value of the variable j does not exceed the maximum value thereof, the CPU 20 returns to Step S12. That is, when time data having the "consistent" result is not acquired by a loop process of Steps S12 to S26, the acquisition of the detection data of the first to the sixth frames of the time code signal, the decoding thereof, and the consistency check thereof are performed in order.

On the other hand, when it is judged that, the value of the variable j exceeds the maximum value thereof in the judging process at Step S26, it is determined that time data having the "consistent" result is not acquired although the maximum number of frames of the time code signal is received, and the CPU 20 ends the decoding and consistency checking process by determining that an error occurs.

By the decoding and consistency checking process, each time one frame of the time code signal is inputted, time data is/are generated by the solo decoding and also by the sum-up decoding when there is time data generated last time. Then, in accordance with the consistency check pattern table 22*b*, the consistency check is performed on the generated time data by the plurality of methods. Time data which acquires the "consistent" result first is determined as accurate time data.

Next, examples of contents of the processes under specific situations are described. For example, there is a case where because of an evenly poor reception environment, accurate time data cannot be acquired by the solo decoding, but can be acquired by the sum-up decoding. In this case, when the first frame (j=1) is received, the time data "1" is acquired as shown in the table of FIG. 6, and the time data "1" is determined as "inconsistent" by the first method (k=1) of the consistency check. When the second frame (j=2) is received, the time data "2" and the time data "1+2" are acquired, and the time data "2" is determined as "inconsistent" by the first method (k=1) of the consistency check, but the time data "1+2" is determined as "consistent" by the second method (k=2) of the consistency check. Therefore, the time data "1+2" is determined as accurate time data.

Furthermore, there is a case where the time calculation data of the time calculating circuit 15 is very wrong, but a reception environment of the standard radio wave is good. In this case, when the first to the third frames (j=1 to 3) are received, the time data "1 (10:12, for example)", the time data "2 (10:13, for example)", the time data "3 (10:14, for example)", the time data "1+2 (10:13, for example)", and the time data "2+3 (10:14, for example)" are acquired. These time data are determined as "inconsistent" by being compared with the time calculation data of the time calculating circuit 15 by the first and the second methods (K=1 and 2) of the consistency check, because there is a large time difference therebetween. On the other hand, the time data "1 (10:12, for example)", the time data "2 (10:13, for example)", and the time data "3 (10:14, for example)" are determined as "consistent" by being compared with one another by the third method (k=3) of the consistency check, because the three time data are disposed at one minute intervals. Therefore, these time data are determined as accurate time data.

Note that various modifications are available with respect to the methods of the consistency check, the time data to be subjected to the consistency check at the time of processing each of the frames, and the steps to store time data into the time data storage region 21*a* in the decoding and consistency checking process.

FIG. 7 is a table for explaining steps to store the time data into the time data storage region 21*a* according to a modification, and FIG. 8 is a table showing contents of a consistency check pattern according to the modification.

In an example of a consistency check pattern table 22*b*1 shown in FIG. 8, the first method (k=1) of the consistency check is a method by which two consecutive time data generated by the solo decoding are compared with each other, and also compared with the time calculation data of the time calculating circuit 15. When there are a time difference of one minute between these two consecutive time data, and a time difference in a predetermined range (±30 sec., for example) between each of the two consecutive time data and the time calculation data of the time calculating circuit 15, the time data are determined as "consistent", and when not, the time data are determined as "inconsistent".

The second method (k=2) of the consistency check is a method by which two time data generated at two-frame intervals by the sum-up decoding are compared with each other, and also compared with the time calculation data of the time calculating circuit 15. When there are a time difference of two minutes between these two time data, and a time difference in the predetermined range (±30 sec., for example) between each of the two time data and the time calculation data of the time calculating circuit 15, the time data are determined as "consistent", and when not, the time data are determined as "inconsistent".

The third method (k=3) of the consistency check is a method by which three consecutive time data generated by the solo decoding are compared with one another. When there is a time difference of one minute between each two consecutive time data, the time data are determined as "consistent", and when not, the time data are determined as "inconsistent". The fourth method (k=4) of the consistency check is a method by which three time data generated at two-frame intervals by the sum-up decoding are compared with one another. When there is a time difference of two minutes between each two consecutive time data, the time data are determined as "consistent", and when not, the time data are determined as "inconsistent".

In the modification, each time one of the first to the sixth frames is inputted, the time data is/are generated based thereon. Then, in accordance with the consistency check pattern table 22*b*1 shown in FIG. 8, the consistency check is performed on the generated time data, indicated by each of the rows, by a method thereof correlated with each of the columns. Time data which acquires the "consistent" result first is determined as accurate time data.

Furthermore, in the modification, each time one of the first to the sixth frames is inputted, the time data is/are generated based thereon. Then, by storing the generated time data in the six storage areas A to F of the time data storage region 21*a* as shown in FIG. 7, the consistency check shown in FIG. 8 can be performed by having only the six storage areas thereof.

[Decoding Process]

Next, the solo decoding and the sum-up decoding performed in Steps S12 to S17 in FIG. 3 are described.

Figure 9:
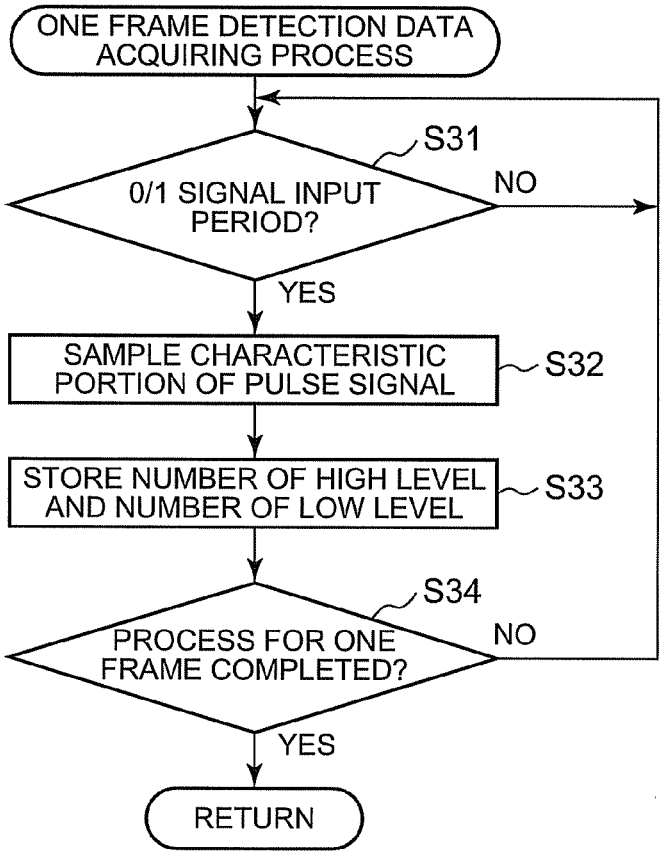
FIG. 9 is a flowchart showing an example of a one frame detection data acquiring process in detail performed at Step S12 in FIG. 3.
Figure 10:
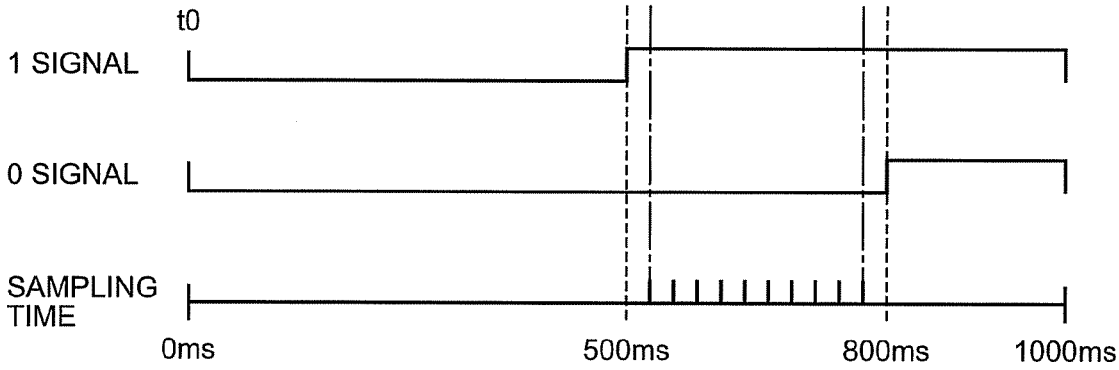
FIG. 10 is a diagram for explaining a sampling process of a characteristic portion.
Figure 24A:
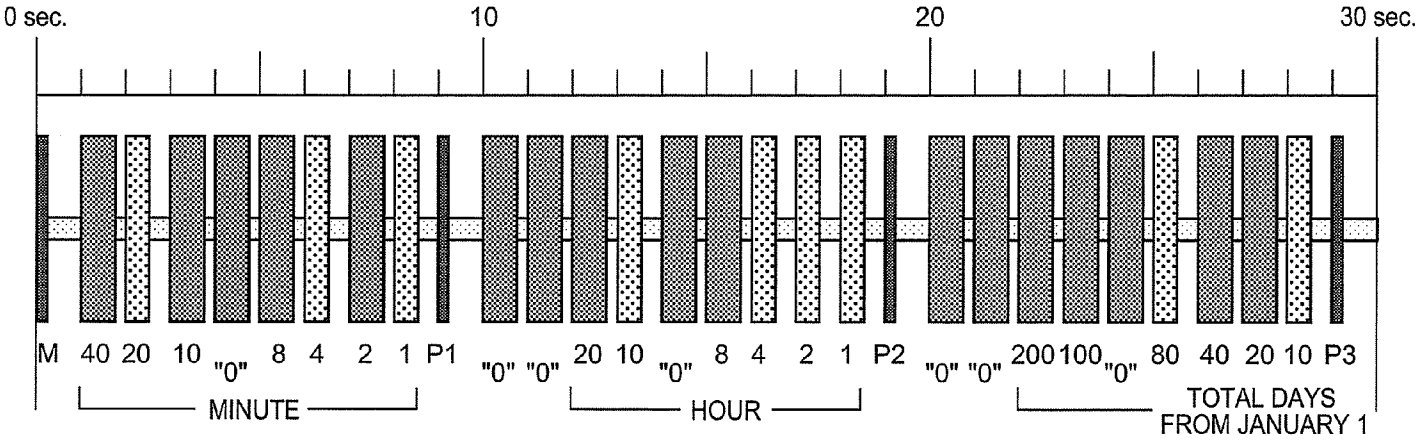
FIGS. 24A and 24B are diagrams showing a format of a time code of Japan.
Figure 24B:
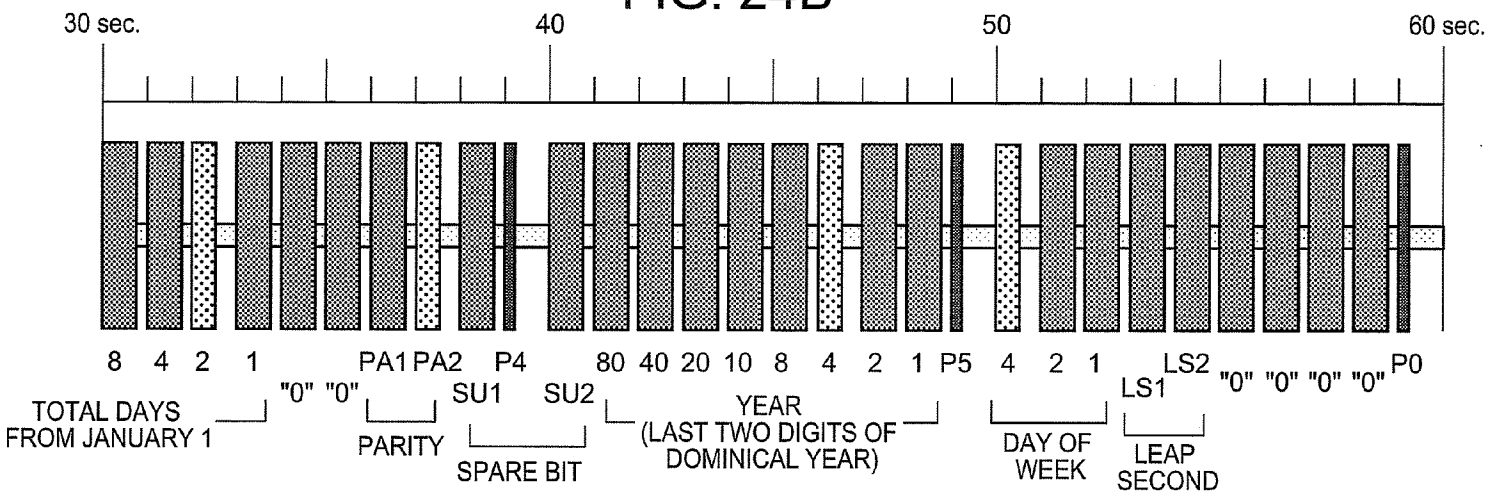

FIG. 9 is a flowchart showing a one frame detection data acquiring process in detail performed at Step S12 in FIG. 3. FIG. 10 is a diagram for explaining a sampling process of a characteristic portion, the sampling process which is performed at Step S32 in FIG. 9. FIGS. 24A and 24B are diagrams showing a format of a time code in Japan.

As shown in FIGS. 24A and 24B, in a time code included in the standard radio wave, 60 codes are arranged at one second intervals to form a code of a frame thereof. Of the 60 codes, a marker (M) and position markers (P1 to P5 and P0) indicating positions in the frame are arranged at positions of 0 sec., 9 sec., 19 sec., 29 sec., 39 sec., 49 sec., and 59 sec. from the starting point of the frame. At each of the other positions, a 0 code or a 1 code is arranged in order to indicate the minute, the hour, the total days from January 1, the year, the day of a week, the leap second, and the parity of time data.

Accordingly, when proceeding to the one frame detection data acquiring process shown in FIG. 9, the CPU 20 determines whether or not it is an input period of a 0 signal or a 1 signal (a pulse signal for a position where the 0 code or the 1 code is arranged) (Step S31). When it is determined as the input period, the characteristic portion of the pulse signal is sampled (the sampling process) (Step S32).

The characteristic portion is an interval where the signal levels of a plurality of types of pulse signals to be subjected to the code determination are different from each other. In the time code of Japan, as shown in FIG. 10, the characteristic portion is an interval where the signal levels of an ideal 0 signal (a pulse signal of the 0 code) and an ideal 0 signal (a pulse signal of the 1 code) are different from each other, i.e. the range of 500 ms to 800 ms with the second synchronization point t0 being defined as a reference. As shown in a sampling time of FIG. 10, the CPU 20 detects the signal level of the characteristic portion of each pulse signal a plurality of times (e.g., 10 times) at predetermined sampling intervals.

After performing the sampling process on one pulse signal, the CPU 20 stores the number of high levels and the number of low levels detected by this sampling process in the RAM 21 in such a way that the number of the detected high levels and the number of the detected low levels are correlated with a bit position of the pulse signal in the time code (step S33). When there is no noise, the number of the high levels is "10" and the number of the low levels is "0" for the pulse signal of the 1 code, while the number of the high levels is "0" and the number of the low levels is "10" for the pulse signal of the 0 code.

After storing the sampling result, the CPU 20 determines whether or not the process for one frame is completed (step S34). When the process is not completed yet, the CPU 20 returns to Step S31, and when the process is completed, the CPU 20 ends the one frame detection data acquiring process. By those processes, the sampling process is performed on the characteristic portions of pulse signals included in one frame of the time code signal, and the result thereof is stored, the pulse signals which are arranged in a range where the 0 code or the 1 code is arranged.

[One Frame Solo Decoding Process]

Figure 11:
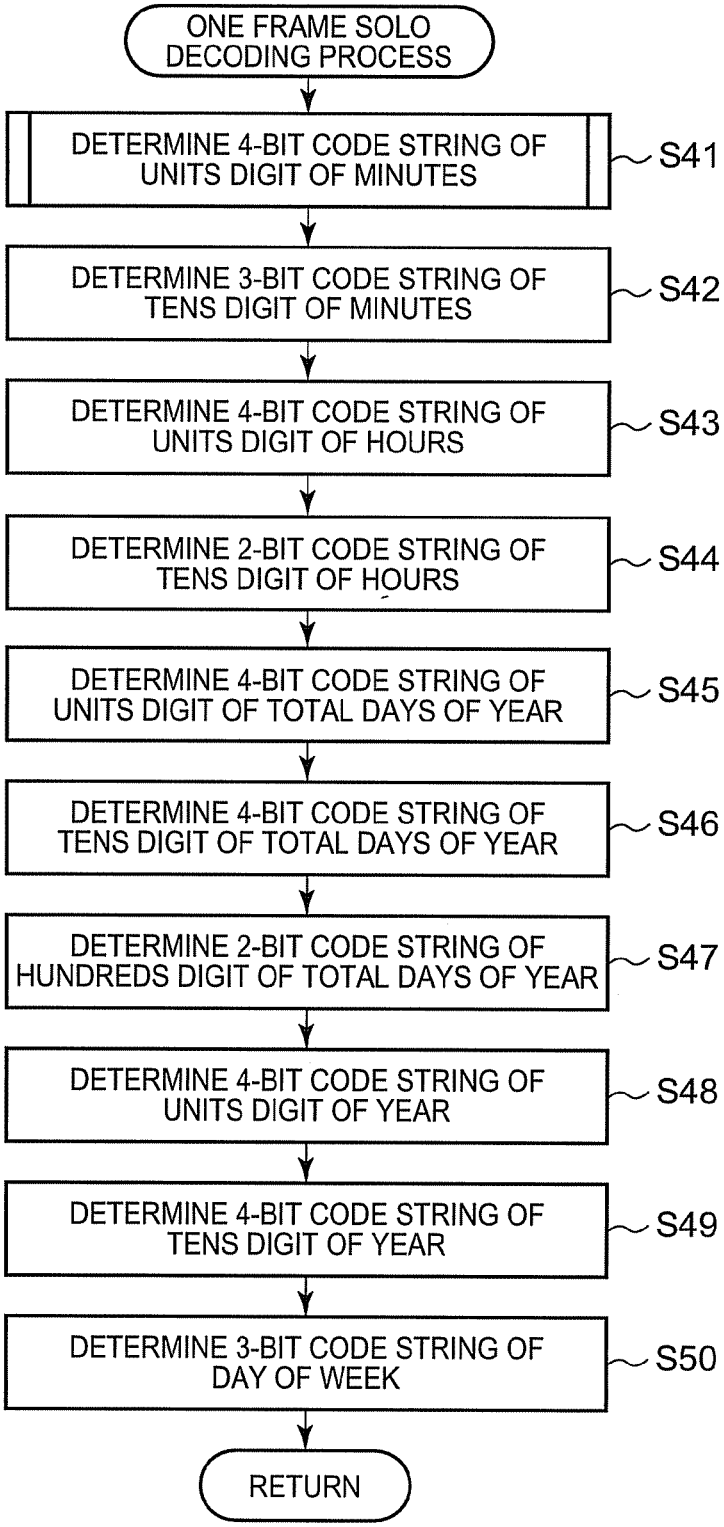
FIG. 11 is a flowchart showing an example of a one frame solo decoding process in detail performed at Step S13 in FIG. 3.

FIG. 11 is a flowchart of the one frame solo decoding process in detail performed at Step S13 in FIG. 3.

After the sampling process for one frame and the storage of the sampling result are completed, the CPU 20 proceeds to the one frame solo decoding process shown in FIG. 11 so as to determine a code string of the time code signal by using data of the sampling result stored at Step S12. The code string determination thereof is not performed by determining a code of each pulse signal individually, but by determining a code string of a group of pulse signals. More specifically, 4 bits (4 bits of 05 sec. to 08 sec. from the minute synchronization point) indicating a value of the units digit of minutes make up one group, and the code string determination is performed on this group (Step S41).

Here, a process of determining a 4-bit code string of the units digit of minutes group by group is described in detail.

Figures 12, 13:
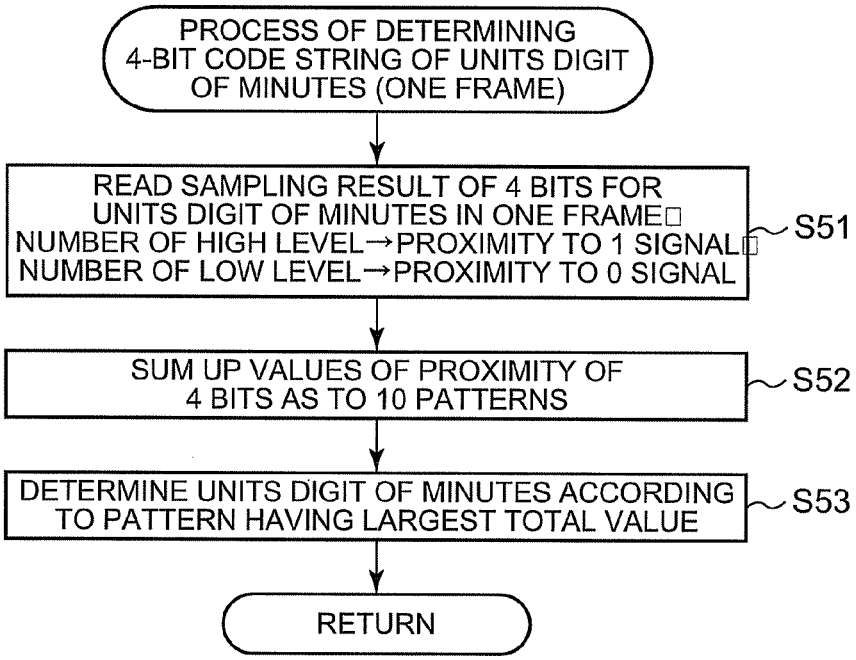
FIG. 12 is a flowchart showing an example of a process of determining a 4-bit code string of the units digit of minutes in detail performed at Step S41 in FIG. 11.
FIG. 13 is a table showing the proximity to a pulse signal of a 0 code and the proximity to a pulse signal of a 1 code with respect to 4 bits indicating the units digit of minutes in an ideal time code signal having no noise.

FIG. 12 is a flowchart showing steps of the process of determining a 4-bit code string of the units digit of minutes performed at Step S41.

When proceeding to the process of determining a 4-bit code string of the units digit of minutes, the CPU 20 reads sampling results of the pulse signals of 4 bits which indicate the units digit of minutes (4 bits of 05 sec. to 08 sec. from the minute synchronization point) from the data of the sampling result of the characteristic portion of the one frame of the time code signal acquired and stored at Step S12 (FIG. 3), and then, sets the number of the high levels as the proximity to the 1 signal, and the number of the low levels as the proximity to the 0 signal, for each pulse signal (Step S51).

FIG. 13 is a table showing proximity to the 0 signal and the proximity to the 1 signal with respect to 4 bits indicating the units digit of minutes in an ideal time code signal having no noise. This example corresponds to a time code signal transmitted and received at x:08.

The original 4-bit code string indicating the units digit of minutes transmitted and received at x:08 is the code string "1000" in the BCD (Binary Coded Decimal) system which expresses "8" in the decimal system. As shown in FIG. 13, in the case of the ideal time code signal having no noise, values of the proximity of the pulse signals of the 4 bits to the codes of the original code string (agreed-codes) are "10", respectively, while values of the proximity of the pulse signals of the 4 bits to the codes different from the codes of the original code string (non-agreed codes) are "0", respectively.

FIG. 15 is a table showing the proximity to a pulse signal of the 0 code and the proximity to a pulse signal of the 1 code with respect to 4 bits indicating the units digit of minutes in a time code signal having noise.

As shown in FIG. 15, in the case of the time code signal having noise, values of the proximity of the pulse signals of the 4 bits to the agreed codes are less than "10", respectively, while values of the proximity of the pulse signals of the 4 bits to the non-agreed codes are more than "0", respectively. That is, the proximity varies. As shown in the "4-minute bit" column and the "1-minute bit" column in FIG. 15, because of the noise, there is a case where a value of the proximity to the 1 signal the code which does not agree with the code of the original code string is larger than a value of the proximity to the 0 signal the code which agrees with the code of the original code string.

In the one frame solo decoding process according to the embodiment, a code of each pulse signal is not determined individually, but a code string of a group of pulse signals is determined. More specifically, code strings which possibly appear in the group are treated as code string determination patterns (determination patterns, hereinbelow), and values each of which indicates a magnitude of an event probability of a determination pattern are acquired based on values of the proximity to each of the codes of each determination pattern. A code string of a determination pattern having the highest event probability, namely, the largest value thereof, is defined as the result of the determination.

FIG. 14 is a table showing determination patterns for a 4-bit code string indicating the units digit of minutes, and total values of the proximity based on the values of the proximity shown in FIG. 13. FIG. 16 is a table showing determination patterns for a 4-bit code string indicating the units digit of minutes, and total values of the proximity based on the values of the proximity shown in FIG. 15.

More specifically, there are 10 determination patterns for a code string which might appear in the 4 bits indicating the units digit of minutes, which patterns are shown in the "BCD value determination pattern for the units digit of minutes" column of the tables in FIGS. 14 and 16. That is, the units digit of minutes is expressed by "0, 1, 2, to 9" in the decimal system, and by code strings "(0000), (0001), (0010), to (1001)" in the BCD system.

Accordingly, the CPU 20 calculates a value indicating the magnitude of the event probability of each determination pattern by summing up values of the proximity of the pulse signals of the 4 bits to the codes the 4 bits of the code string of each of the 10 determination patterns (Step S52). For example, with respect to the determination pattern "0, (0000)" in FIG. 14, the CPU 20 sums up values of the proximity of the 4 bits of the $j^{th}$ frame to the 0 signal (See FIG. 13). The result is "30".

The calculation described above is performed on the 10 determination patterns each of which might appear in the 4 bits. In the "total value of proximity" column of the table in FIG. 14, the total values of the proximity with respect to the 10 patterns are shown.

After the calculation described above, the CPU 20 compares the total values of the proximity with one another, thereby determining the determination pattern having the largest total value as the one having the highest event probability, and determining the same as the pattern of the code string of the units digit of minutes of the received time code signal (Step S53: FIG. 12).

In the example shown in FIG. 14, since the total value "40" is the maximum as shown by hatching in the table, the code string of the determination pattern "8, (1000)" in the row is determined as the code string of the 4 bits indicating the units digit of minutes.

In the case of the time code signal having noise as shown in FIGS. 15 and 16 too, the CPU 20 calculates a value of the event probability with respect to each of the 10 determination patterns for the 4 bits which is a group of pulse signals indicating the units digit of minutes, thereby acquiring the total value of the proximity "28" as the maximum value as shown by hatching in the table of FIG. 16. The code string of the determination pattern "9, (1001)" in the row is determined as the code string of the 4 bits indicating the units digit of minutes. Although the determination result is wrong, a value of the "4-minute bit" is determined as a correct value "0" since the code string is determined group by group.

When the code string of the 4 bits indicating the units digit of minutes is determined, the CPU 20 returns to the one frame solo decoding process shown in FIG. 11, and in a similar way to the way described above, determines a code string of 3 bits indicating the tens digit of minutes (a code string of 01 sec. to 03 sec. from the minute synchronization point) (Step S42), a code string of 4 bits indicating the units digit of hours (a code string of 15 sec. to 18 sec. from the minute synchronization point) (Step S43), a code string of 2 bits indicating the tens digit of hours (a code string of 12 sec. and 13 sec. from the minute synchronization point) (Step S44), a code string of 4 bits indicating the units digit of total days of a year (total days from January 1) (a code string of 30 sec. to 33 sec. from the minute synchronization point) (Step S45), a code string of 4 bits indicating the tens digit of total days of a year (a code string of 25 sec. to 28 sec. from the minute synchronization point) (Step S46), a code string of 2 bits indicating the hundreds digit of total days of a year (a code string of 22 sec. and 23 sec. from the minute synchronization point) (Step S47), a code string of 4 bits indicating the units digit of the year (a code string of 45 sec. to 48 sec. from the minute synchronization point) (Step S48), a code string of 4 bits indicating the tens digit of the year (a code string of 41 sec. to 44 sec. from the minute synchronization point) (Step S49), and a code string of 3 bits indicating the day of a week (a code string of 50 sec. to 52 sec. from the minute synchronization point) (Step S50) in order.

By such one frame solo decoding process, the time data is generated, the time data which indicates the year, the month, the date, the day of a week, the hour, and the minute. The CPU 20 ends the one frame solo decoding process, and proceeds to its next step in the decoding and consistency checking process shown in FIG. 3.

[Two Frame Sum-up Decoding Process]

Figure 17:
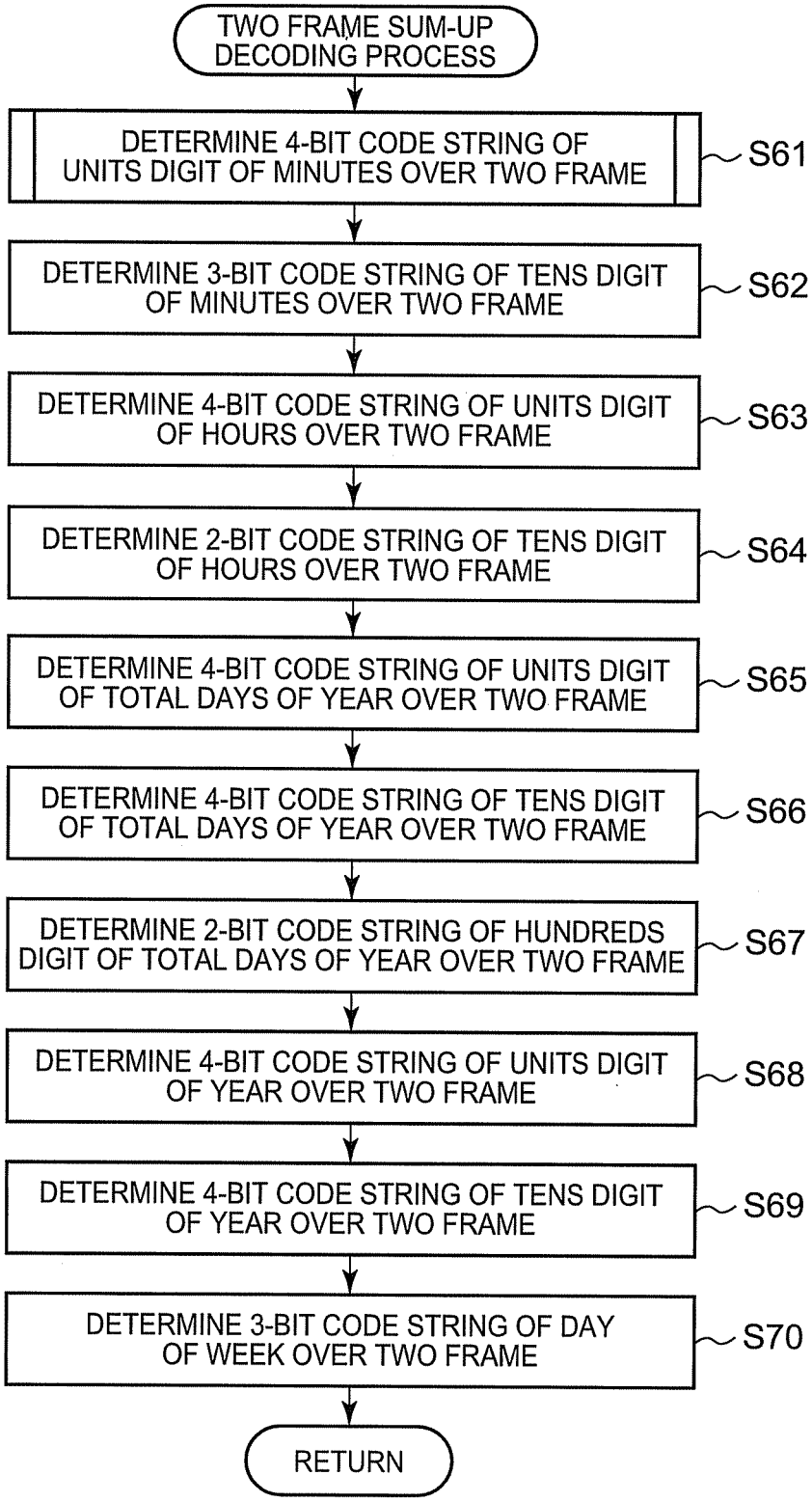
FIG. 17 is a flowchart showing an example of a two frame sum-up decoding process in detail performed at Step S16 in FIG. 3.

FIG. 17 shows a flowchart of the two frame sum-up decoding process in detail performed at Step S16 in FIG. 3.

The CPU 20 proceeds to the two frame sum-up decoding process in a state where the detection data acquiring process at Step S12 in FIG. 3 is performed twice so that the sampling data of two frames of the time code signal are stored. By using the stored sampling data of the two frames, the code string determination of the time code signal is performed. The code string determination thereof is not performed by determining a code of each pulse signal individually, but by determining a code string of a group of pulse signals over two frames. More specifically, 4 bits indicating a value of the units digit of minutes with respect to each of the two frames, i.e. 8 bits of the time code signal, make up one group, and the code string determination is performed on this group (Step S61).

Here, a process of determining a 4-bit code string of the units digit of minutes over two frames is described in detail.

Figure 18:
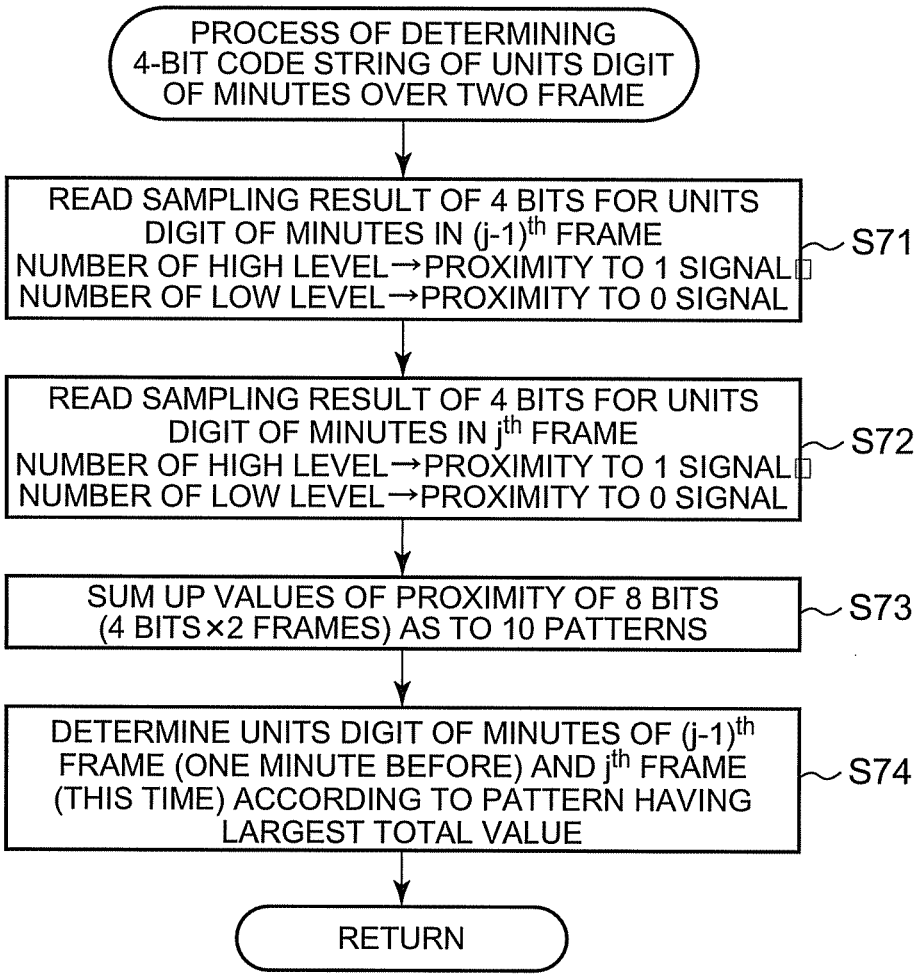
FIG. 18 is a flowchart showing an example of a process of determining a 4-bit code string of the units digit of minutes over two frames in detail performed at Step S61 in FIG. 17.

FIG. 18 is a flowchart showing steps of the process of determining a 4-bit code string of the units digits of minutes over two frames performed at step S61.

When proceeding to the process of determining a 4-bit code string of the units digits of minutes over two frames, the CPU 20 reads sampling results of the pulse signals of the 4 bits which indicate the units digit of minutes (4 bits of 05 sec. to 08 sec. from the minute synchronization point), the sampling results which are acquired by receiving the $(j-1)^{th}$ frame, from the data of the sampling result of the characteristic portion stored at Step S12 in FIG. 3, and then, sets the number of the high levels as the proximity to the 1 signal and the number of the low levels as the proximity to the 0 signal, with respect to each of the pulse signals (Step S71).

Similarly, the CPU 20 reads sampling results of the pulse signals of the 4 bits indicating the units digit of minutes, the sampling results which are acquired by receiving the $j^{th}$ frame, and sets the number of the high levels as the proximity to the 1 signal and the number of the low levels as the proximity to the 0 signal, with respect to each of the pulse signals (Step S72).

FIGS. 19A and 19B are tables each of which shows the proximity to the 0 signal and the proximity to the 1 signal with respect to 4 bits indicating the units digit of minutes in an ideal time code signal having no noise, wherein FIG. 19A is for the $(j-1)^{th}$ frame transmitted and received at x:08, while FIG. 19B is for the $J^{th}$ frame transmitted and received at x:09.

The original 4-bit code string indicating the units digit of minutes transmitted and received at x:08 is the code string "1000" in the BCD (Binary Coded Decimal) system which expresses "8" in the decimal system. The original 4-bit code string indicating the units digit of minutes transmitted and received at x:09 is the code string "1001" in the BCD system which expresses "9" in the decimal system. As shown in FIGS. 19A and 19B, in the case of the ideal time code signal having no noise, values of the proximity of the pulse signals of the 4 bits to agreed codes are "10", respectively, while values of the proximity of the pulse signals of the 4 bits to the non-agreed codes are "0", respectively.

FIGS. 21A and 21B are tables showing the proximity to a pulse signal of the 0 code and the proximity to a pulse signal of the 1 code with respect to 4 bits indicating the units digit of minutes in a time code signal having noise, wherein FIG. 21A is for the $(j-1)^{th}$ frame transmitted and received at x:08, while FIG. 21B is for the $j^{th}$ frame transmitted and received at x:09.

As shown in FIGS. 21A and 21B, in the case of the time code signal having noise, values of the proximity of the pulse signals of the 4 bits to the agreed codes are less than "10", respectively, while values of the proximity of the pulse signals of the 4 bits to the non-agreed codes are more than "0", respectively. That is, the proximity varies. As shown in the "4-minute bit" column in FIG. 21A, because of the noise, there is a case where a value of the proximity to the 1 signal the code which does not agree with the code of the original code string is larger than a value of the proximity to the 0 signal the code which agrees with the code of the original code string.

Accordingly, when a code of each of the 4 bits is determined individually in accordance with values of the proximity, with respect to the ideal time code signal having no noise shown in FIGS. 19A and 19B, it is correctly determined that the code string of the $(j-1)^{th}$ frame is "1000", and the code string of the $j^{th}$ frame is "1001", by choosing, as to each of the 4 bits, a code having a larger value of the proximity. On the other hand, with respect to the time code signal having noise shown in FIGS. 21A and 21B, it is erroneously determined that the code string of the $(j-1)^{th}$ frame is "1101", and the code string of the $j^{th}$ frame is "1001", by choosing, as to each of the 4 bits, a code having a larger value of the proximity.

For this reason, in the two frame sum-up decoding process according to the embodiment, a code of each pulse signal is not determined individually, but a code string of a group of pulse signals is determined. More specifically, combinations of codes strings which possibly appear in the group over two frames are treated as determination patterns, and values each of which indicates a magnitude of an event probability of a determination pattern are acquired based on values of the proximity to each of the codes of each determination pattern. Code strings of a determination pattern having the highest event probability, namely, the largest value thereof, are defined as the result of the determination.

FIG. 20 is a table showing the determination patterns for the 4-bit code string indicating the units digit of minutes over two frames, and total values of the proximity based on the values of the proximity shown in FIGS. 19A, and 19B. FIG. 22 is a table showing the determination patterns for a 4-bit code string indicating the units digit of minutes over two frames, and total values of the proximity based on the values of the proximity shown in FIGS. 21A and 21B.

More specifically, there are 10 determination patterns for combinations of code strings which might appear in the 4 bits indicating the units digit of minutes over two frames, which patterns are shown in the "$(j-1)^{th}$ frame (one minute before)" column and the "$J^{th}$ frame (this time)" column under the "BCD value determination pattern for units digit of minutes" column of the tables in FIGS. 20 and 22. That is, the units digit of minutes of the $(J-1)^{th}$ frame is expressed by "0, 2, to 9" in the decimal system, and by code strings "(0000), (0001), (0010), to (1001)" in the BCD system, and the units digit of minutes of the $J^{th}$ frame is expressed by "1, 2, to 9, 0" in the decimal system, the value in the $j^{th}$ frame which is obtained by adding "+1" to the value in the $(j-1)^{th}$ frame in the decimal system, and by code strings "(0001), (0010), to (0001), (1000)" in the BCD system. This is because a value of units digit of minutes is updated by "+1" frame by frame.

Accordingly, the CPU 20 calculates a value of the event probability of each determination pattern, which is a combination of code strings for two frames, by summing up values of the proximity of the pulse signals of the 8 bits (4 bits×2 frames=8 bits) to the codes of the 8 bits of the code strings for two frames of each of the 10 determination patterns (Step S73; FIG. 18). For example, with respect to the determination pattern "0, (0000)" for the $(j-1)^{th}$ frame and "1, (0001)" for the $j^{th}$ frame in FIG. 20, the CPU 20 sums up values of the proximity of the 4 bits of the $(j-1)^{th}$ frame to the 0 signal (see FIG. 19A) and values of the proximity of the high-order 3 bits, i.e. "8-minut bit", "4-minute bit", and "2-minute bit", of the $j^{th}$ frame to the 0 signal and of the low-order 1 bit, i.e. "1-minute bit", of the $j^{th}$ frame to the 1 signal (See FIG. 19B). The result is "60".

The calculation described above is performed on each of the 10 determination patterns each of which might appear in the 4 bits of each of the two frames. Under the "total value of proximity" column in FIG. 20, total values of the proximity with respect to only the $(J-1)^{th}$ frame are shown in the "one minute before" column, total values of the proximity with respect to only the $J^{th}$ frame are shown in the "this time" column, and total values of the proximity with respect to the two frames are shown in the "total" column.

After the calculation described above, the CPU 20 compares the total values of the proximity with respect to the two frames with one another, thereby determining the determination pattern having the largest total value as the one having the highest event probability, and determining the same as the pattern for the code strings for the two frames of the units digit of minutes of the received time code signal (Step S74). Then, the CPU 20 ends the process of determining a 4-bit code string of the units digit of minutes over two frames.

In the example shown in FIG. 20, since the total value "80" is the maximum as shown by hatching in the table, the code strings of the pattern in the row, which are "8, (1000)" for the $(j-1)^{th}$ frame and "9, (1001)" for the $J^{th}$ frame, are determined as the code strings of the 4 bits indicating the units digit of minutes for the two frames. The sampling is performed on the two frames, i.e., the "$(j-1)^{th}$ frame (one minute before)" and the "$J^{th}$ frame (this time)", whereby "9 minutes" which is the value of the $J^{th}$ frame received just before is determined as the value of the units digit of minutes of the current time data.

As shown in FIGS. 21A, 21B and 22, there is a case where a noise is included and an erroneous determination might be made when a code of each pulse signal is determined individually. Even in such a case, the CPU 20 calculates a value of the event probability with respect to each of the 10 determination patterns for the 8 bits which is a group of pulse signals over two frames indicating the units digit of minutes for the two frames, thereby acquiring the total value of the proximity "53" as the maximum value for the two frames as shown by hatching in the table of FIG. 22. Accordingly, the code strings of the determination pattern "8, (1000)" for the "$(j-1)^{th}$ frame and "9, (1001)" for the $j^{th}$ frame in the row are determined as the code strings for the 4 bits which indicate the units digit of minutes for the two frames. That is, by acquiring a value of the proximity from two frames of the time code signal in total, the correct determination result is acquired.

When the code string of the 4 bits indicating the units digit of minutes is determined over two frames, the CPU 20 returns to the two frame sum-up decoding process shown in FIG. 17, and in a similar way to the way described above, determines a code string of 3 bits indicating the tens digit of minutes over two frames (Step S62), a code string of 4 bits indicating the units digit of hours over two frames (Step S63), a code string of 2 bits indicating the tens digit of hours over two frames (Step S64), a code string of 4 bits indicating the units digit of total days of a year (total days from January 1) over two frames (Step S65), a code string of 4 bits indicating the tens digit of total days of a year over two frames (Step S66), a code string of 2 bits indicating the hundreds digit of total days of a year over two frames (Step S67), a code string of 4 bits indicating the units digit of the year over two frames (Step S68), a code string of 4 bits indicating the tens digit of the year over two frames (Step S69), and a code string of 3 bits indicating the day of a week over two frames (Step S70) in order.

The determination patterns for a 4-bit string of the units digit of minutes over two frames are only 10 patterns as shown in the "BCD value determination pattern of units digit of minutes" column in FIG. 20. It is because the $(j-1)^{th}$ frame and the $J^{th}$ frame are always different from each other by "+1" in a value of the units digit of minutes. However, code strings indicating the other digits have other determination patterns as compared with the units digit of minutes. That is, with respect to the code strings indicating the other digits, when there is no carry from its lower digit, the $(j-1)^{th}$ frame and the $J^{th}$ frame have a same value in the target digit. On the other hand, when there is a carry from its lower digit, the $(j-1)^{th}$ frame and the $J^{th}$ frame are different from each other by "+1" in the target digit. Accordingly, with respect to all the determination patterns with or without carry, total values of the proximity are acquired so as to acquire a determination pattern having the largest total value thereof, and the code strings thereof are determined as the code strings of the $(j-1)^{th}$ frame and the $J^{th}$ frame for the target digit.

In a case where the result of the code string determination of the lower digit is a pattern with no carry to its higher digit, i.e. to the target digit, but the result of the code string determination of the target digit is a pattern with a carry from the lower digit, the CPU 20 may proceed to an error process by determining that accurate time data is not acquired.

Also, in the opposite case as well, the CPU 20 may proceed to an error process by determining that accurate time data is not acquired.

Furthermore, by limiting the period of performing the time correcting process, for example, to a period during which there is no carry from the units digit of hours to the tens digit of hours, in the process of determining a code string of the tens digit of hours or a higher digit, the code string determination can be performed by eliminating, from the determination patterns with or without a carry, the patterns with a carry. Accordingly, a load of an arithmetic process can be reduced.

Figure 23:
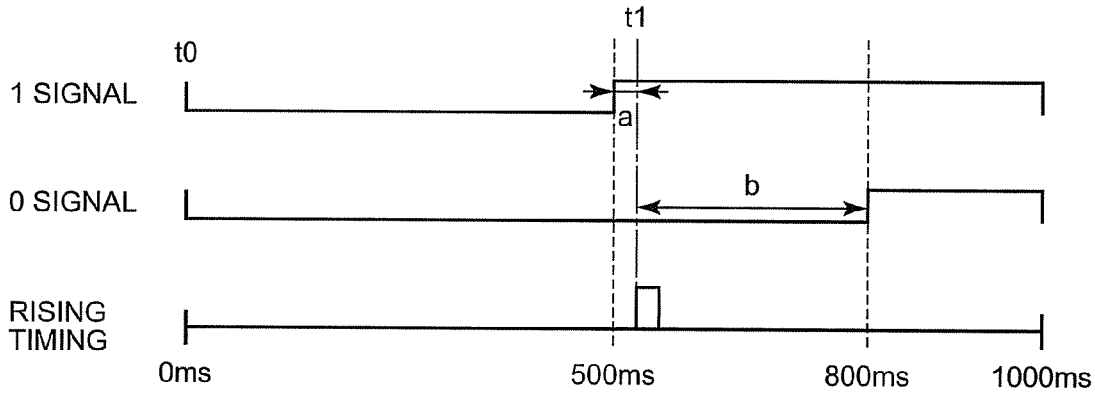
FIG. 23 is a diagram for explaining how to acquire the proximity of each pulse signal to the 0 signal and to the 1 signal according to a modification.

FIG. 23 is a diagram for explaining how to acquire the proximity of each pulse signal to the 0 signal and to the 1 signal according to a modification.

In the above-described embodiment, in order to acquire the proximity indicating to what degree each pulse signal is close to the 1 signal and the 0 signal, the signal level of each pulse signal is sampled in the characteristic portion in which the 1 signal and the 0 signal are different from each other in the signal level. However, the proximity can also be acquired by a method shown in FIG. 20. The example shown in FIG. 23 is suitable for the configuration in which the CPU 20 detects changes which are the falling edge of the time code signal from the high level to the low level and the rising edge thereof from the low level to the high level. In this configuration, as shown in the rising timing in FIG. 23, time is counted from the second synchronization point t0 to a time t1 when the rising edge of the time code signal is detected by the CPU 20. Then, whether or not the time t1 is close to 500 ms of the 1 signal or to 800 ms of the 0 signal is expressed by a numerical value by using, for example, a time difference a between the rising time t1 of the time code signal and the rising edge of the 1 signal and a time difference b between the rising time t1 thereof and the rising edge of the 0 signal. With this process, the proximity to the 1 signal and the proximity to the 0 signal can be acquired.

Even when the proximity to the 0 signal and the proximity to the 1 signal are acquired in such a way described above, the code string determination thereafter can be performed by the same way described above.

It is possible that, when the one frame solo decoding process and the two frame sum-up decoding process are performed, the accuracy of the generated time data varies and the time data with an error are generated depending on a situation, for example, where noise is evenly included in the time code signal, or where noise is temporarily included in the time code signal. However, even in such a case, accurate time data having the "consistent" result can be extracted by the consistency check described above.

As described above, according to the radio-controlled timepiece 1 and the decoding and consistency checking process of the embodiments, the time data having the "consistent" result (the time data having the consistency) is/are extracted by generating time data by the solo decoding and the sum-up decoding, and by performing the consistency check by a plurality of types of methods together. Accordingly, as compared with a case where time data is generated by using a same number of frames of a time code signal always, more accurate time information/time data can be acquired.

Furthermore, according to the radio-controlled timepiece 1 and the decoding and consistency checking process of the embodiments, as a method of the consistency check, the method is adopted, the method by which the generated time data is compared with the time calculation data of the time calculating circuit 15 in order to determine the consistency. Accordingly, accurate time data can be promptly acquired in a case where the radio-controlled timepiece 1 is under a normal use condition. It is because when the radio-controlled timepiece 1 is under a normal use condition, a time difference between the generated time data and the time calculation data should be within a range of normal time calculation error of the radio-controlled timepiece 1, and hence, when the time difference is out of the range, there should be some error in the code determination of the time code signal.

Furthermore, according to the radio-controlled timepiece 1 of the embodiments, as another method of the consistency check, the method is adopted, the method by which the time data generated by decoding different frames of the time code signal are compared with one another in order to determine the consistency. Accordingly, even in a case where the time calculation data of the radio-controlled timepiece 1 is very wrong, when accurate time data is acquired, the time data can be correctly determined for sure.

Furthermore, according to the radio-controlled timepiece 1 of the embodiments, each time one frame of the time code signal is inputted, the processes of generating the time data by the solo decoding, performing the consistency check of the time data generated by the solo decoding, generating the time data by the sum-up decoding, and/or performing the consistency check of the time data generated by the sum-up decoding, are performed when possible. Accordingly, time data determined as "consistent" can be promptly determined as accurate time data.

Furthermore, according to the radio-controlled timepiece 1 of the embodiments, at the maximum, six frames of the time code signal are inputted, and 11 time data are generated, accordingly. However, because newly generated time data is/are stored in such a way that while the time data used for the consistency check later is/are being kept, the time data not used therefor is/are replaced, time data can be stored and the consistency check can be performed with a small capacity of a storage region.

The present invention is not limited to the embodiments described above, and hence various modifications are available. For example, in the embodiments, as a method of decoding a time code signal by using detection data of only one frame thereof, the method is used, the method by which the code string determination is performed every one group, the group which has a plurality of pulse signals included in the time code signal. However, this is not a limit, and hence a method by which a code of every one pulse signal is determined so that the code of the time code signal is determined may be adopted. Furthermore, various known technologies for decoding a time code signal by using detection data of only one frame thereof may be adopted, instead.

Furthermore, in the embodiments, as a method of decoding a time code signal by combining detection data of a plurality of frames thereof so as to perform the code determination thereon, the method is used, the method by which the code string determination is performed every one group, the group which has a plurality of pulse signals over two frames included in the time code signal. However, this is not a limit, and hence a method by which a code of each pulse signal is determined by using the detection data of the two frames may be adopted. Furthermore, the number of frames of the time code signal, the detection data of the frames which are combined, is not limited to two, and may be more than two. Furthermore, various known technologies for decoding a time code signal by combining detection data of a plurality of frames thereof may be adopted, instead.

Furthermore, in the embodiments, in the method of the consistency check, the method by which the generated time data is compared with the time calculation data in order to determine the consistency, when a time difference therebetween is within a predetermined range (±30 sec.), the generated time data is determined as "consistent", and when not, the generated time data is determined as "inconsistent". However, the predetermined range of the time difference is not necessarily to be fixed, and may fluctuate depending on an elapsed time from the last time the time correcting process is performed.

Furthermore, in the embodiments, it is determined in accordance with the consistency check pattern table 22*b* or 22*b*1 that by which method of the consistency check, the consistency check is performed on which generated time data. However, this is not a limit, and hence it may be determined in accordance with a program by which a judgment is made in accordance with a condition. The details of the present invention shown in the embodiments can be appropriately modified without departing from the scope of the present invention.

This application is based upon and claims the benefit of priority under 35 USC 119 of Japanese Patent Application No. 2010-167837 filed on Jul. 27, 2010, the entire disclosure of which, including the description, claims, drawings, and abstract, is incorporated herein by reference in its entirety.

What is claimed is:

1. A time information acquiring apparatus comprising:

a first decoder which decodes a time code signal frame by frame so as to generate solo-decoded time information, the time code signal which is extracted and inputted from a standard radio wave;

a first determining section which determines consistency of the solo-decoded time information generated by the first decoder;

a second decoder which combines detection data of a plurality of the frames of the time code signal, and performs a code determination on the time code signal based on the combined detection data of the frames so as to generate sum-up-decoded time information;

a second determining section which determines the consistency of the sum-up-decoded time information generated by the second decoder; and a controller which makes (i) the first decoder generate the solo-decoded time information, (ii) the first determining section determine the consistency of the solo-decoded time information, (iii) the second decoder generate the sum-up decoded time information, and (iv) the second determining section determine the consistency of the sum-up-decoded time information in a predetermined order so as to extract time information having the consistency.

2. The time information acquiring apparatus according to claim 1 further comprising:

a time calculating section which calculates time, wherein, the first determining section includes a first comparing and determining section which compares the solo-decoded time information generated by the first decoder with the time calculated by the time calculating section so as to determine the consistency of the solo-decoded time information, and the second determining section includes a second comparing and determining section which compares the sum-up-decoded time information generated by the second decoder with the time calculated by the time calculating section so as to determine the consistency of the sum-up-decoded time information.

3. The time information acquiring apparatus according to claim 2, wherein the first determining section includes a third comparing and determining section which determines whether or not a plurality of the solo-decoded time information generated by the first decoder based on the frames different from one another have a difference corresponding to a time interval between the frames different from one another, so as to determine the consistency of the plurality of the solo-decoded time information, and the second determining section includes a fourth comparing and determining section which determines whether or not a plurality of the sum-up-decoded time information generated by the second decoder based on the frames different from one another have a difference corresponding to a time interval between the frames different from one another, so as to determine the consistency of the plurality of the sum-up-decoded time information.

4. A radio-controlled timepiece comprising:

the time information acquiring apparatus according to claim 3, the time information acquiring apparatus to which the time code signal is inputted, and which acquires the time information having the consistency;

a time calculating section which calculates time;

a radio wave receiving section which receives the standard radio wave so as to output the time code signal to the time information acquiring apparatus; and a time correcting section which corrects the time calculated by the time calculating section based on the time information acquired by the time information acquiring apparatus.

5. A radio-controlled timepiece comprising:

the time information acquiring apparatus according to claim 2, the time information acquiring apparatus to which the time code signal is inputted, and which acquires the time information having the consistency;

a time calculating section which calculates time;

a radio wave receiving section which receives the standard radio wave so as to output the time code signal to the time information acquiring apparatus; and a time correcting section which corrects the time calculated by the time calculating section based on the time information acquired by the time information acquiring apparatus.

6. The time information acquiring apparatus according to claim 1, wherein the first determining section includes a third comparing and determining section which determines whether or not a plurality of the solo-decoded time information generated by the first decoder based on the frames different from one another have a difference corresponding to a time interval between the frames different from one another, so as to determine the consistency of the plurality of the solo-decoded time information, and the second determining section includes a fourth comparing and determining section which determines whether or not a plurality of the sum-up-decoded time information generated by the second decoder based on the frames different from one another have a difference corresponding to a time interval between the frames different from one another, so as to determine the consistency of the plurality of the sum-up-decoded time information.

7. A radio-controlled timepiece comprising:

the time information acquiring apparatus according to claim 6, the time information acquiring apparatus to which the time code signal is inputted, and which acquires the time information having the consistency;

a time calculating section which calculates time;

a radio wave receiving section which receives the standard radio wave so as to output the time code signal to the time information acquiring apparatus; and a time correcting section which corrects the time calculated by the time calculating section based on the time information acquired by the time information acquiring apparatus.

8. The time information acquiring apparatus according to claim 1, wherein each time one of the frames of the time code signal is inputted, the controller makes, when possible, (i) the first decoder generate the solo-decoded time information, (ii) the first determining section determine the consistency of the solo-decoded time information, (iii) the second decoder generate the sum-up-decoded time information, and/or (iv) the second determining section determine the consistency of the sum-up-decoded time information, and the controller extracts the solo-decoded time information or the sum-up-decoded time information determined as consistent first by the first determining section or the second determining section as the time information having the consistency.

9. The time information acquiring apparatus according to claim 8 further comprising:

a storing section including a plurality of storage areas where the solo-decoded time information and the sum-up-decoded time information can be stored, wherein each time one of the frames of the time code signal is inputted, and the solo-decoded time information or the sum-up-decoded time information is generated by the first decoder or the second decoder, the controller stores the generated time information in an empty storage area of the storage areas, or stores the generated time information in a storage area of the storage areas in such a way that the generated time information replaces the time information previously generated and not used by the first determining section and the second determining section to determine the consistency, and the first determining section and the second determining section use the time information stored in the storage areas so as to determine the consistency.

10. A radio-controlled timepiece comprising:

the time information acquiring apparatus according to claim 9, the time information acquiring apparatus to which the time code signal is inputted, and which acquires the time information having the consistency;

a time calculating section which calculates time;

a radio wave receiving section which receives the standard radio wave so as to output the time code signal to the time information acquiring apparatus; and a time correcting section which corrects the time calculated by the time calculating section based on the time information acquired by the time information acquiring apparatus.

11. A radio-controlled timepiece comprising:

the time information acquiring apparatus according to claim 8, the time information acquiring apparatus to which the time code signal is inputted, and which acquires the time information having the consistency;

a time calculating section which calculates time;

a radio wave receiving section which receives the standard radio wave so as to output the time code signal to the time information acquiring apparatus; and a time correcting section which corrects the time calculated by the time calculating section based on the time information acquired by the time information acquiring apparatus.

12. A radio-controlled timepiece comprising:

the time information acquiring apparatus according to claim 1, the time information acquiring apparatus to which the time code signal is inputted, and which acquires the time information having the consistency;

a time calculating section which calculates time;

a radio wave receiving section which receives the standard radio wave so as to output the time code signal to the time information acquiring apparatus; and a time correcting section which corrects the time calculated by the time calculating section based on the time information acquired by the time information acquiring apparatus.

* * * * *